US007848700B2

(12) United States Patent
Kim

(10) Patent No.: US 7,848,700 B2
(45) Date of Patent: Dec. 7, 2010

(54) ALTERNATE RADIO DATA FREQUENCY SELECTION

(75) Inventor: Joo Cheol Kim, Osan-si (KR)

(73) Assignee: LG Electronics Inc., Seoul (KR)

( * ) Notice: Subject to any disclaimer, the term of this patent is extended or adjusted under 35 U.S.C. 154(b) by 1058 days.

(21) Appl. No.: 11/559,305

(22) Filed: Nov. 13, 2006

(65) Prior Publication Data

US 2007/0220579 A1 Sep. 20, 2007

(30) Foreign Application Priority Data

Mar. 15, 2006 (KR) ..... 10-2006-0023884
Mar. 15, 2006 (KR) ..... 10-2006-0023885

(51) Int. Cl.
*H04H 20/71* (2008.01)

(52) U.S. Cl. ..... 455/3.01; 455/3.05

(58) Field of Classification Search ..... 455/3.01
See application file for complete search history.

(56) References Cited

U.S. PATENT DOCUMENTS 5,303,401 A * 4/1994 Duckeck et al. ..... 455/186.1
5,390,343 A * 2/1995 Rupprecht et al. ..... 455/161.3
2002/0022461 A1* 2/2002 Gierl ..... 455/184.1
2006/0183482 A1* 8/2006 Ueda ..... 455/439
2007/0112613 A1* 5/2007 Jones ..... 705/9
2007/0129035 A1* 6/2007 Olson et al. ..... 455/179.1

FOREIGN PATENT DOCUMENTS

KR 10-1999-023715 3/1999

* cited by examiner

*Primary Examiner*—Yuwen Pan
*Assistant Examiner*—Ankur Jain
(74) *Attorney, Agent, or Firm*—Fish & Richardson P.C.

(57) ABSTRACT

Alternate radio data frequency selection involves receiving radio data system signals and extracting region tables from the radio data system signals, with the region tables each including a quantity of alternate frequencies and a list of alternate frequencies. The quantity and list of alternate frequencies included in the region tables are compared with each other if the quantity of alternate frequencies included in a region table is equal to or greater than the quantity of frequencies included in another region table. One of the alternate frequencies included in the region table is identified if each of the alternate frequencies in the list of alternate frequencies included in each region table, and the identified alternate frequency is output if each of the alternate frequencies in the list of alternate frequencies is included in each region table. A seek operation is performed if any of the alternate frequencies in the list of alternate frequencies is not included in each region table.

11 Claims, 22 Drawing Sheets

1000

| 1001 | 1002 |
|---|---|
| QUANTITY OF ALTERNATE FREQUENCIES | FREQUENCY |

FIG. 10A

1004

| | |
|---|---|
| #5 | AF1 |
| AF2 | AF3 |
| AF4 | AF5 |

FIG. 10B

1005

| | |
|---|---|
| #9 | 99.5 |
| 89.3 | 99.5 |
| 99.5 | 100.9 |
| 104.8 | 99.5 |
| 99.5 | 89.1 |

FIG. 10C

ALTERNATE RADIO DATA FREQUENCY SELECTION

CROSS REFERENCE TO RELATED APPLICATION

This application claims priority to Korean Patent Application Nos. 10-2006-0023884 and 10-2006-0023885, both filed on Mar. 15, 2006, which are incorporated herein by reference.

BACKGROUND

1. Field

The present disclosure generally relates to radio broadcasts, and one particular implementation relates to the selection of an alternate frequency using a radio data system ("RDS") or radio broadcast data system ("RBDS") receiver.

2. Description of the Related Art

During radio broadcasts, conventional RDS or RBDS receivers continuously check both a main frequency and alternate frequencies, where the main frequency is typically the frequency via which a specific program is currently being broadcast, and an alternate frequency is typically a separate frequency which may also be broadcasting the same program. Depending upon factors such as signal quality, signal strength, or ultrasonic noise, a conventional RDS or RBDS receiver may switch between the main frequency and an alternate frequency to improve the quality of a received broadcast.

SUMMARY

According to one general implementation, a stored master table includes a quantity of alternate frequencies associated with a main frequency for at least first and second regions. When at least first and second radio data system signals are received, a first region table is extracted from the first radio data system signal, and a second region table is extracted from the second radio data system signal, with each region table including a quantity of alternate frequencies and a list of alternate frequencies. The quantity of alternate frequencies for the second region which is stored in the master table is compared with the quantity of alternate frequencies included in the second region table. If the quantity of alternate frequencies included in the second region table is equal to or greater than the quantity of alternate frequencies for the second region stored in the master table, the list of alternate frequencies included in the second region table is compared with the list of alternate frequencies included in the first region table. One of the alternate frequencies included in the second region table is identified if each of the alternate frequencies in the list of alternate frequencies included in the first region table exists in the second region table. The identified alternate frequency is output if each of the alternate frequencies in the list of alternate frequencies included in the first region table exists in the second region table. A seek operation is performed if each of the alternate frequencies in the list of alternate frequencies included in the first region table does not exist in the second region table.

Implementations may include one or more of the following features. For example, a regional range code may be extracted from the radio data system signal, and a determination may be made as to whether to output the one of the alternate frequencies or perform the seek operation based upon the regional range code being indicative of an international code or a national code. An alternate frequency completion flag may be stored if each of the alternate frequencies in the list of alternate frequencies included in the first region table exists in the second region table.

According to another general implementation, at least first and second radio data system signals are received, a first region table is extracted from the first radio data system signal and a second region table is extracted from the second radio data system signal, with each region table including a quantity of alternate frequencies and a list of alternate frequencies. The quantity of alternate frequencies included in the second region table is compared with the quantity of alternate frequencies included in the first region table, and the list of alternate frequencies included in the second region table is compared with the list of alternate frequencies included in the first region table if the quantity of alternate frequencies included in the second region table is equal to or greater than the quantity of frequencies included in the first region table. One of the alternate frequencies included in the second region table is identified if each of the alternate frequencies in the list of alternate frequencies included in the first region table exists in the second region table, and the identified alternate frequency is output if each of the alternate frequencies in the list of alternate frequencies included in the first region table exists in the second region table. A seek operation is performed if each of the alternate frequencies in the list of alternate frequencies included in the first region table does not exist in the second region table.

Implementations may include one or more of the following features. For example, an alternate frequency completion flag may be stored if each of the alternate frequencies in the list of alternate frequencies included in the first region table exists in the second region table. A regional range code may be extracted from the radio data system signal, and a determination may be made as to whether the regional range code is indicative of an international code or a national code. One of the alternate frequencies included in the second region table may be output if the alternate frequency completion flag is stored and the regional range code is indicative of an international code or a national code, and a seek operation may be performed if the alternate frequency completion flag is not stored, or if the alternate frequency completion flag is stored and the regional range code is not indicative of an international code or a national code.

According to another general implementation, a device includes a storage medium, a tuner, and a processor. The storage medium is configured to store a master table including a quantity of alternate frequencies associated with a main frequency for at least first and second regions. The tuner is configured to receive at least first and second radio data system signals. The processor is configured to extract a first region table from the first radio data system signal and a second region table from the second radio data system signal, with each region table including a quantity of alternate frequencies and a list of alternate frequencies. The processor is further configured to compare the quantity of alternate frequencies for the second region stored in the master table with the quantity of alternate frequencies included in the second region table, and to compare the list of alternate frequencies included in the second region table with the list of alternate frequencies included in the first region table if the quantity of alternate frequencies included in the second region table is equal to or greater than the quantity of alternate frequencies for the second region stored in the master table. The processor is further configured to identify one of the alternate frequencies included in the second region table if each of the alternate frequencies in the list of alternate frequencies included in the first region table exists in the second region table. Moreover, the processor is configured to output the identified alternate frequency if each of the alternate frequencies in the list of alternate frequencies included in the first region table exists in the second region table, and to perform a seek operation if each of the alternate frequencies in the list of alternate frequencies included in the first region table does not exist in the second region table.

According to another general implementation, a device includes a tuner and a processor. The tuner is configured to receive at least first and second radio data system signals. The processor is configured to extract a first region table from the first radio data system signal and a second region table from the second radio data system signal, with each region table including a quantity of alternate frequencies and a list of alternate frequencies, to compare the quantity of alternate frequencies included in the second region table with the quantity of alternate frequencies included in the first region table, and to compare the list of alternate frequencies included in the second region table with the list of alternate frequencies included in the first region table if the quantity of alternate frequencies included in the second region table is equal to or greater than the quantity of frequencies included in the first region table. The processor is further configured to identify one of the alternate frequencies included in the second region table if each of the alternate frequencies in the list of alternate frequencies included in the first region table exists in the second region table, to output the identified alternate frequency if each of the alternate frequencies in the list of alternate frequencies included in the first region table exists in the second region table, and to perform a seek operation if each of the alternate frequencies in the list of alternate frequencies included in the first region table does not exist in the second region table.

The details of one or more implementations are set forth in the accompanying drawings and the description below. Other features will be apparent from the description and drawings, and from the claims.

BRIEF DESCRIPTION OF THE DRAWINGS

FIGS. 10A to 10C depict exemplary alternate frequency list structures.

Like reference numbers represent corresponding parts throughout.

DETAILED DESCRIPTION

According to one general implementation, a receiver stores a main frequency and at least one alternate frequency in memory, to allow the receiver to search for an alternate frequency with a stronger signal if necessary. Even when multiple alternate frequencies are stored, however, a receiver may have difficulty locating an alternate frequency that is broadcasting the same program code as the program broadcast on the main frequency. For example, if a receiver is mounted in a vehicle which is passing through a very long tunnel, or if the alternate frequency is associated with a region that the vehicle has traveled out of, the receiver may encounter problems searching for a particular program. In such a situation, the receiver may perform a seek operation, in which each frequency in the frequency band is checked determine if the program identification code of the frequency matches that of the program broadcast on the main frequency, and may output the frequency identified by the seek operation.

Figure 1:
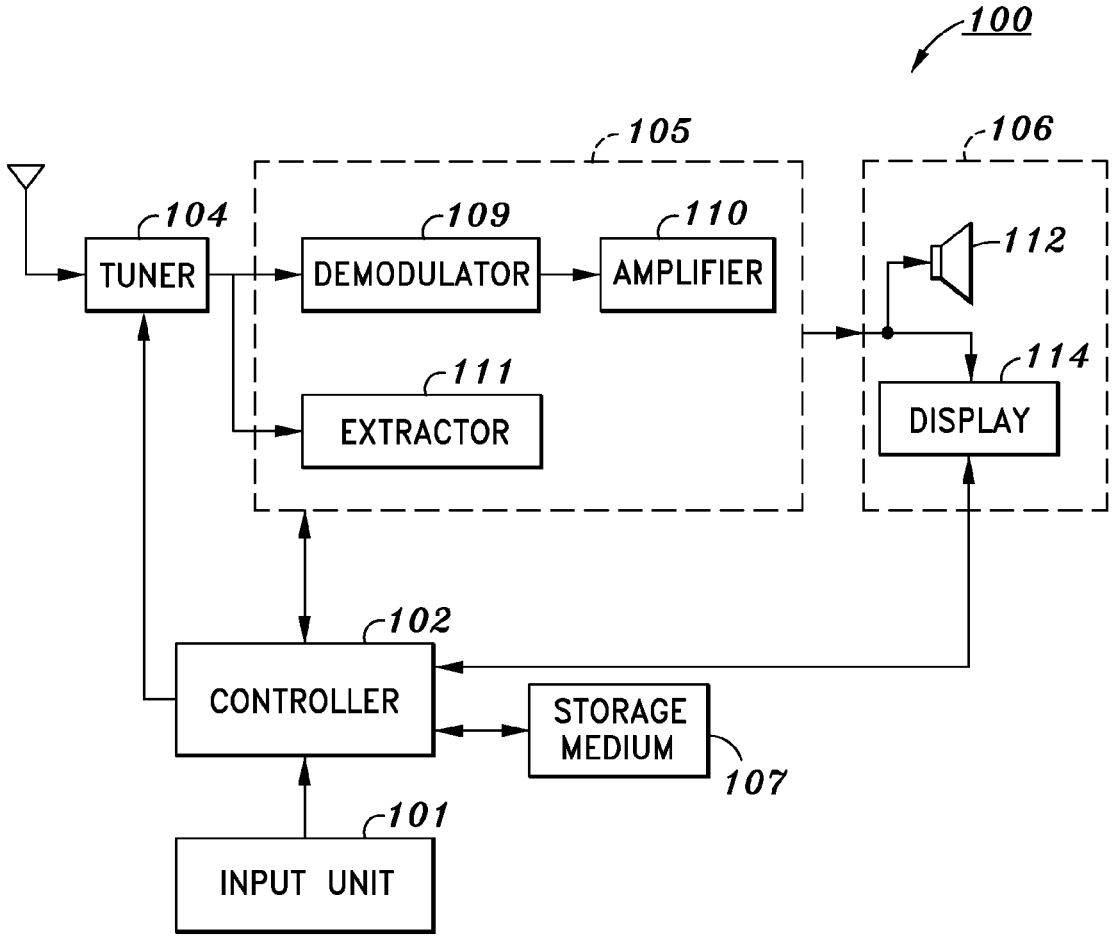
FIG. 1 is a block diagram depicting an exemplary receiver.

FIG. 1 is a view of an exemplary receiver 100, which may be an RDS or RBDS receiver. The receiver 100 includes an input unit 101 for selecting an operation of the receiver 100 via a user input, a controller 102 for controlling the operation of each component of the receiver 100 according to the user input, a tuner 104 for selecting and receiving a broadcast signal, a broadcast signal processing unit 105 for processing the broadcast signal received by the tuner 104 into an output signal suitable for output to the user via an output unit 106, and a storage medium 107 for storing data associated with the operation of the receiver 100 and data associated with broadcast program information.

In more detail, the input unit 101 is configured to allow a user to input a control command for operating the receiver 100, and to initially select a broadcast channel or frequency through which a desired program is received. The input unit 101 includes keys, buttons, or other controls provided on a surface of the receiver proximate and accessible to the user. The tuner 104 detects and outputs broadcast signals when the user selects a broadcast channel or frequency to receive via the input unit 101. The broadcast signals may be composite signals, such as RDS or RBDS composite signals.

The broadcast signal processing unit 105 further includes a demodulator 109 for demodulating broadcast signals received via the tuner 104 and for outputting audio signals, an amplifier 110 for amplifying the audio signals output from the demodulator 109 and for outputting the amplified audio signals to the output unit 106, and an extractor 111 for extracting data from the broadcast signals received from the tuner 104 and for providing the extracted data to the controller 102. The extracted data may be RDS or RBDS data.

The output unit 106 further includes a speaker 112 for outputting amplified audio signals received from the amplifier 110 in the form of audio sound waves, and a display 114 for displaying character information corresponding to the extracted data extracted by the extractor 111. The storage medium 107 is a flash memory that can read and write program data useful for the operation of the receiver 100, and also stores alternate frequency information and/or broadcast program-related data.

Figure 2A:
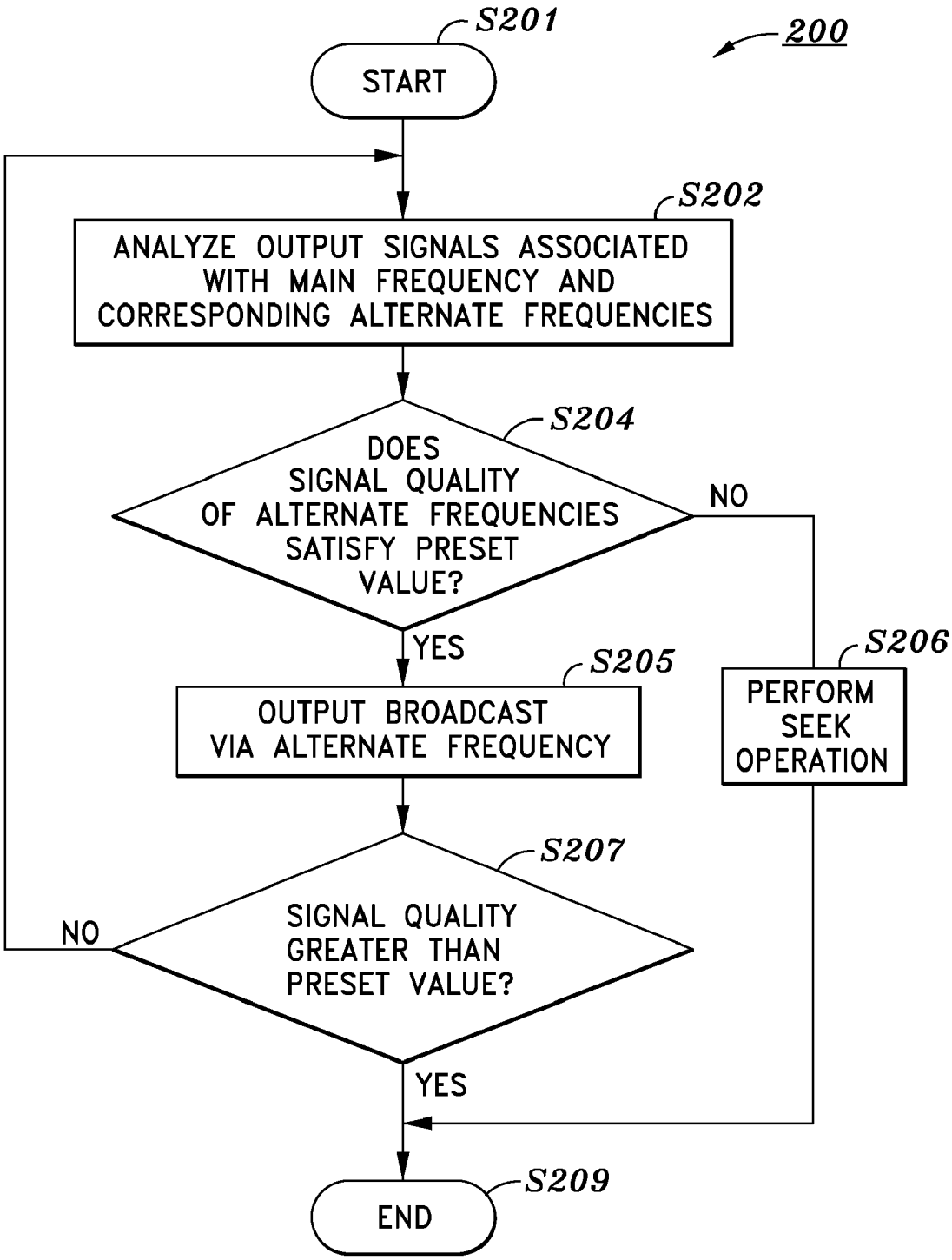
FIGS. 2A and 2B are flowcharts depicting exemplary methods for selecting an alternate frequency using a receiver.
Figure 2B:
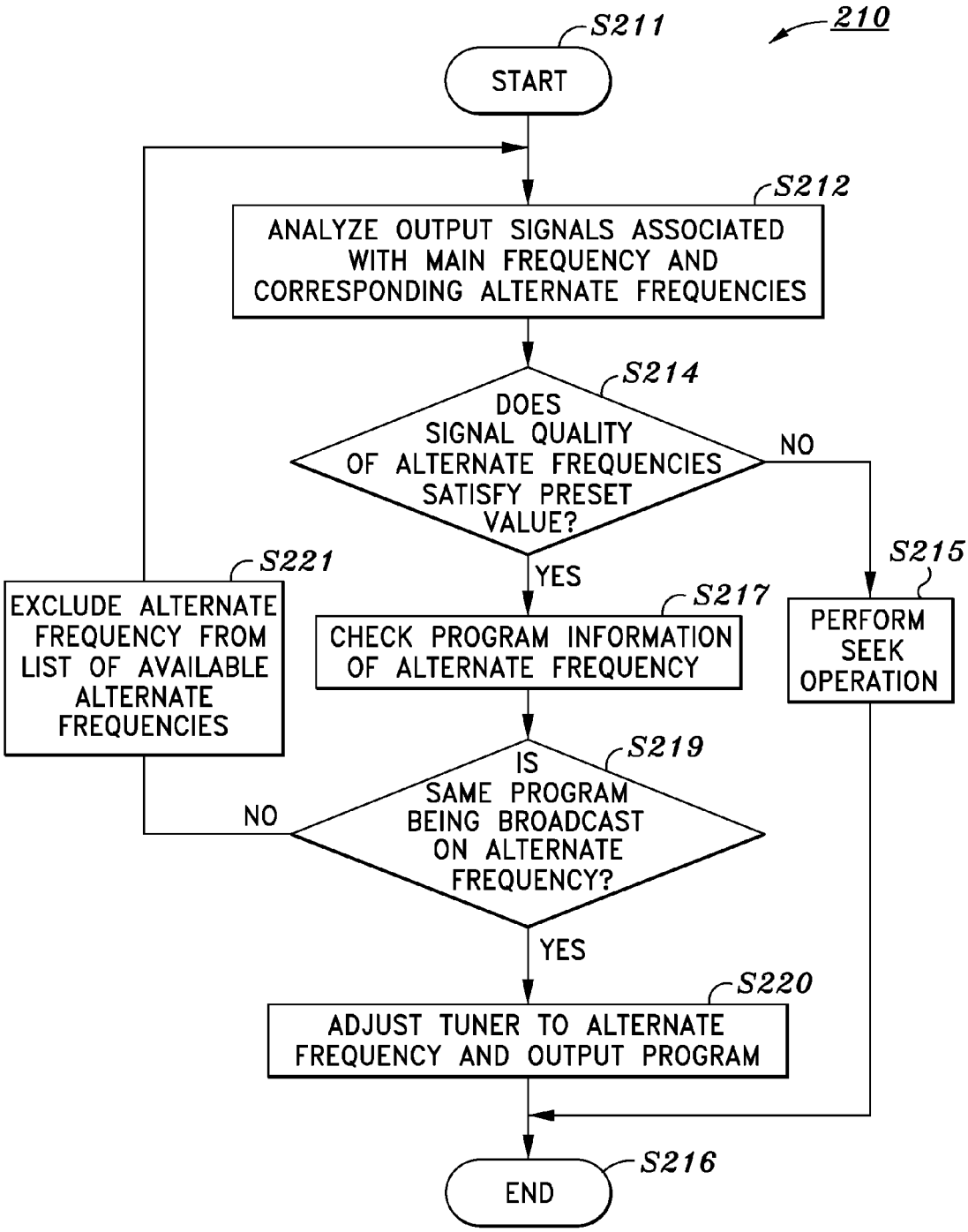

FIGS. 2A and 2B are flowcharts depicting respective exemplary methods 200 and 210 for selecting an alternate frequency using a receiver. In FIG. 2A, when the method 200 begins (S201), the controller 102 analyzes a signal level output from the broadcast signal processing unit 105. When the quality of the broadcast signals received on the main frequency is less than a preset value, the controller 102 searches for an alternate frequency through which a higher quality signal may be received (S202). In more detail, the controller 102 mutes the output of the speaker 112, retrieves a table of alternate frequencies associated with the main frequency from the storage medium 107, and tunes the tuner 104 to each of the alternate frequencies. The broadcast signal processing unit 105 processes the broadcast signal and outputs an output signal for each of the alternate frequencies, and the controller 102 analyzes the signal quality of each output signal.

If the signal quality of any of the output signals for the alternate frequencies is greater than a preset value (S204), the controller 102 sets the channel of the receiver 100 to that of the corresponding alternate frequency, and the output of the speaker 112 is restored so as to allow the program to be output to the user (S205).

If none of the output signals for the alternate frequencies has a signal quality which is greater than the preset value (S204), a seek operation is performed (S206). In the seek operation, each frequency in the entire frequency band is searched in order to find a frequency through which the same program broadcast on the main frequency is broadcast. Programs are identified by matching the program code of the program on the main frequency with the program code of the program on the particular alternate frequency under scrutiny.

When the receiver is mounted in a vehicle which has traveled from one region to another, a search for a particular program should be performed on other frequencies which are not stored as alternate frequencies. For example, the receiver 100 may receive a desired program with program code A123 on a main frequency of 88 MHz in Washington, D.C., where alternate frequencies 92 MHz and 95 MHz are associated with the 88 MHz main frequency in Washington, D.C. If the receiver 100 is mounted in a vehicle which travels from Washington, D.C. to New York, the initially-set frequency of 88 MHz may correspond to a program code of C345 when the user activated the receiver 100. Thus, even when a radio broadcast is being normally output to the user, the controller 102 may still determine whether the signal quality is greater than the preset value (S207). When the signal quality is less than the set reference value (S207), the process may be repeated (S202), until a higher quality signal is found (S207) and the method 200 ends (S209).

The seek operation may require that the speaker 112 be muted for up to about eight seconds at a time. Since the seek operation is continuously performed until a frequency is located that satisfies the preset signal quality value, it is possible that the seek operation could occur several times in a row, such that no sound is output from the receiver 100 for an extended period of time. Accordingly, in order to minimize the time where the speaker 112 is muted, the seek operation should occur infrequently.

Referring to FIG. 2B, when the method 210 begins (S211), the controller 102 analyzes the signal quality of the output signal associated with the main frequency that is output from the broadcast signal processing unit 105. When the signal quality of the program received via the main frequency is less than a preset value, a search of alternate frequencies is performed so that a higher quality signal may be received (S212). This search is similar to the search performed in FIG. 2A (S202).

When the signal quality of the main frequency and those of each corresponding alternate frequency are less than the preset value (S214), a seek operation is performed in order to search for the same program on a different frequency (S215), and the method 210 ends (S216). On the other hand, if the signal quality of one of the alternate frequencies is greater than or equal to a preset value (S214), the program information of that alternate frequency is checked (S217) to determine whether the program which is being broadcast on the alternate frequency matches the program which is being broadcast on the main frequency.

If the same program is being broadcast on the alternate frequency (S219), the current frequency is adjusted from the main frequency to the alternate frequency, the speaker 112 is unmuted, the program is output as normal (S220), and the method 210 ends (S216). However, if a different program is being broadcast on the alternate frequency (S219), the tuner remains on the main frequency, and the corresponding alternate frequency is excluded from the list of available alternate frequencies (i.e. is "blank marked") (S221). By excluding specific frequencies from the list of available alternate frequencies, the search is able to proceed more quickly in the future if such a search procedure is required again.

If the receiver 100 is mounted in a vehicle which travels to a second region where the excluded alternate frequency is broadcasting the same program as the main frequency, the alternate frequency will be detected during a seek operation (S215), and will not be selected based upon the list of available alternate frequencies (S212). It is helpful to perform the seek operation on an alternate frequency excluded from the list of available alternate frequencies in the case where the receiver 100 moves into a different region, despite the fact that the seek operation takes an extended amount of time.

Figure 3:
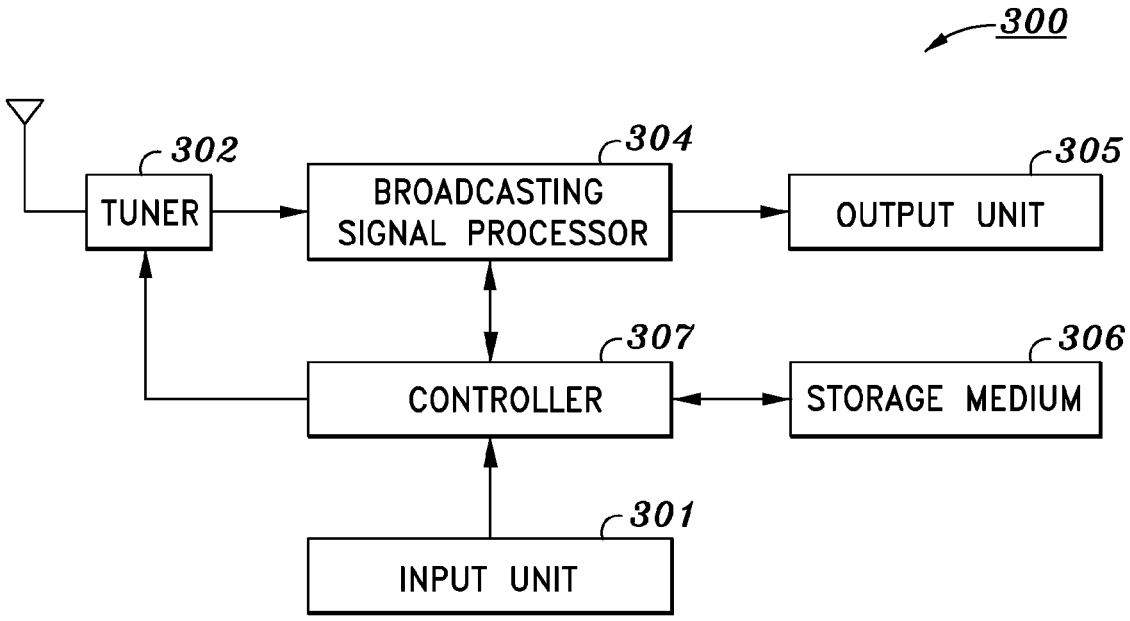
FIGS. 3 to 5 are block diagrams depicting exemplary receivers.

FIG. 3 is a block diagram illustrating an exemplary receiver 300 that includes an input unit 301 for receiving a user input, a tuner 302 for receiving radio signals via an antenna, a broadcast signal processor 304 for processing signals from the tuner 302, and an output unit 305 for outputting audio signals to a user. The receiver 300 also includes a storage medium 306 for storing program information, related programs, and an alternate frequency list and other data, and a controller 307. The controller controls components of the receiver 300 according to the user input, and also controls the alternate frequency searching process when the signal quality of received broadcast signals is less than a preset value.

In the receiver 300, the controller 307 checks the signal quality of a main frequency and each of alternate frequencies stored in the storage medium 306. When the signal quality of a program received via the main frequency degrades to less than a preset value, the controller 307 switches to an alternate frequency so that higher quality signals may be received. In particular, the controller tunes the tuner 302 to each of the alternate frequencies, and outputs a tuned signal to the broadcast signal processor 304 for each of the alternate frequencies. The broadcast signal processor 304 processes the tuned signals, outputs an output signal to the output unit 305, and outputs data to the controller 307.

The controller 307 detects the quality of the alternate frequency signals received at the tuner 302 using the output signals processed by broadcast signal processor 304. The controller 307 then controls the alternate frequency searching process based upon information contained in the program information code of the main frequency. In one example, the alternate frequency searching process is based upon information found in the second nibble (i.e. the second four bits) of the program information code. In another example, the alternate frequency searching process is based upon information found in the second nibble of the program information code as well as an alternate frequency list completion flag, when the signal quality of a program received via each of the alternate frequencies is less than a set value.

Figure 4:
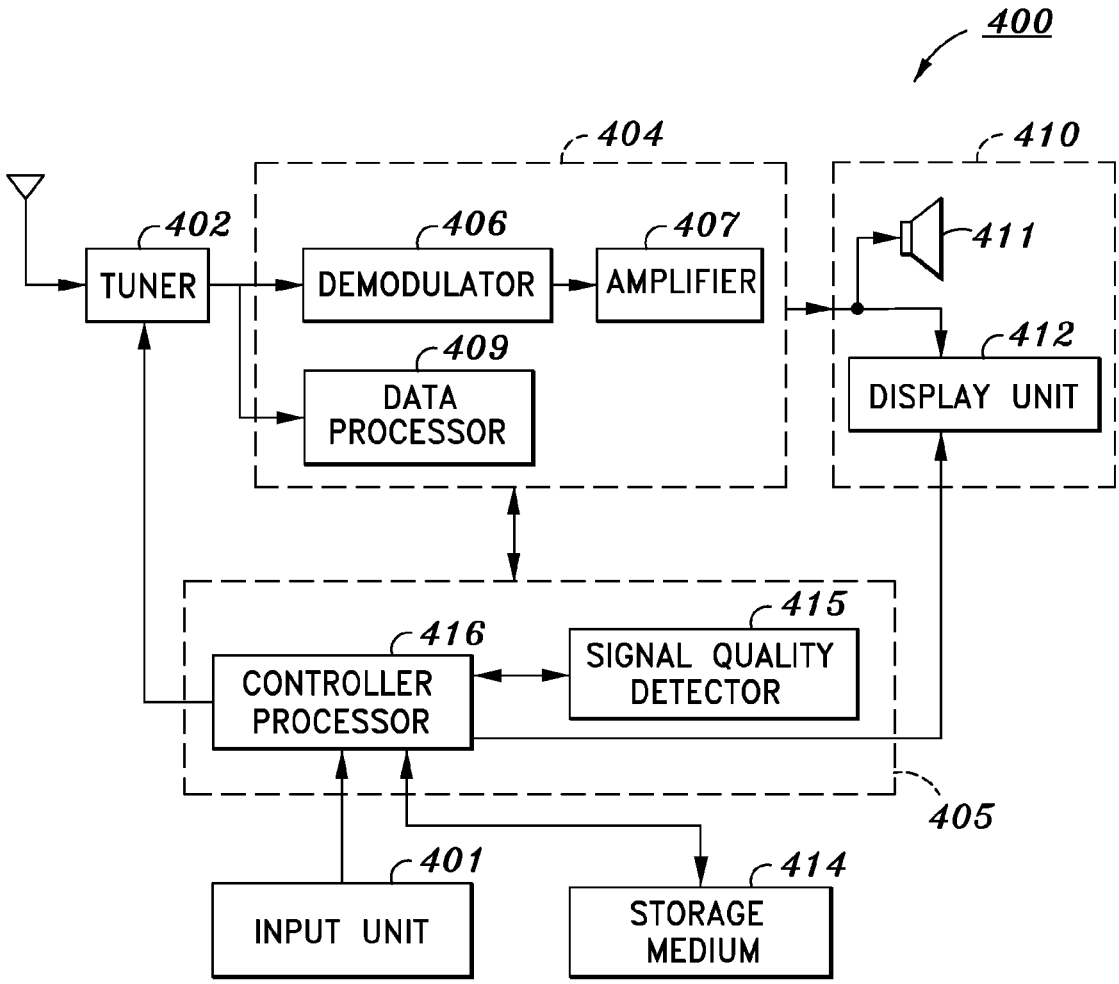

FIG. 4. is a diagram illustrating another exemplary receiver 400. The receiver 400 includes an input unit 401 which further includes keys, buttons or controls on a surface adjacent to the user. The input unit 401 effectuates the receipt of a user input for operating the receiver 400 and selecting a frequency by which a desired program is broadcast. The receiver 400 also includes a tuner 402 which detects signals, such as RDS composite signals, broadcast via a frequency associated with the user input. In response to a user input from a controller 405, the tuner 402 outputs tuner signals to the broadcast signal processor 404.

The broadcast signal processor 404 further includes a demodulator 406 for demodulating the tuner signals received from the tuner 402 and for outputting audio signals. The broadcast signal processor 404 also includes an amplifier 407 for amplifying audio signals from the demodulator 406, and a data processor 409 for extracting data from the tuner signals received from the tuner 402, and for transmitting the extracting data to the controller 405. In one example, the extracted data is RDS data or RBDS data. The output unit 410 further includes a speaker 411 for outputting audio signals from the amplifier 407 in the form of audible sound waves, and a display unit 412 for displaying character information corresponding to the extracted data output from the data processor 409.

The storage medium 414 is, for example, a flash memory that reads and writes data used for the operation of the receiver 400, program information data, and alternate frequency information. The storage medium 414 also stores alternate frequency list completion flag information, which is set by the controller 405 at the appropriate time. For example, the alternate frequency list completion flag may be set when it is determined that an alternate frequency is broadcasting the same program as is being broadcast on a main frequency.

The controller 405 also includes a signal quality detector 415 for detecting an output level of the demodulator 406 or an output of the data processor 409, and for determining the quality of output signals. The controller 405 also includes a controller processor 416 for determining the program information code information of a main frequency and corresponding alternate frequencies, and for controlling the alternate frequency searching process based upon an output of the signal quality detector 415.

The controller 405 also determines whether to perform a seek operation, and controls the alternate frequency searching process when the signal quality of a signal received by the receiver 400 is less than a preset value, or when the program information of an alternate frequency signal with high signal quality is different from the program information of the main frequency. In an alternative implementation, the functions of the signal quality detector 415 are performed by the controller processor 416.

The determination of whether to perform the alternate frequency searching process is based upon data contained in the program information code and/or whether the alternate frequency list completion flag is set. When the signal quality of the broadcast signals which are output from the signal quality detector 415 is less than a preset value, the controller processor 416 detects the program information of the main frequency from the data output by the data processor 409, or data stored in the storage medium 414. The controller processor 416 then effectuates the control of a seek operation if the second four bits of the program information code are indicative of a national or international code or program.

In more detail, the program information code is a series of sixteen bits that are divided into four sets of four bits each. If the second four bits are indicative of a national code or an international code, the seek operation can be expeditiously performed in order to search for an alternate frequency broadcasting the same program.

Figure 5:
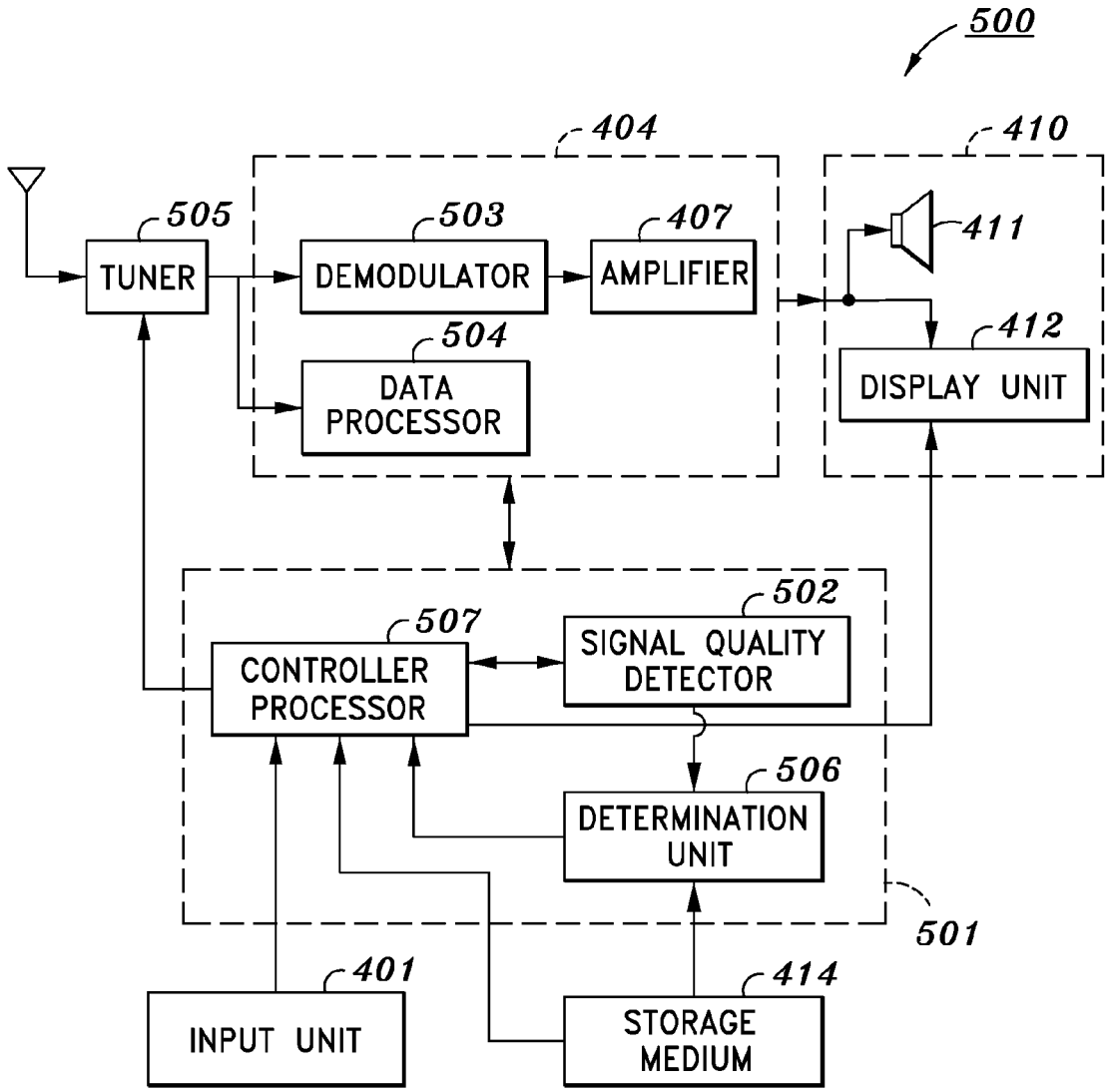

FIG. 5 is a block diagram illustrating another exemplary receiver 500. Many of the components of receiver 500 are similar to those of receiver 400, and description of these components is thus omitted for the sake of brevity. The receiver 500 includes a controller 501 that further includes a signal quality detector 502 for detecting an output level output from a demodulator 503 or a data processor 504. The signal quality detector 502 also outputs a signal quality indicator signal indicative of the signal quality of a broadcast signal received by the tuner 505. The controller 501 also includes a determination unit 506 for determining whether to perform a seek operation based upon program information, such as the second four bits of the program information code or the alternate frequency list completion flag. The controller 501 further includes a controller processor 507 for controlling the alternate frequency searching process, depending upon the determination made by the determination unit 506. In an alternate implementation, the functions performed by the signal quality detector 502 and/or the determination unit 506 are performed by the controller processor 507.

In one example, when the signal quality of a broadcast signal is less than a preset value, the determination unit 506 uses the second four bits of the program information code corresponding to the main frequency, and/or the alternate frequency list completion flag to determine whether to perform a seek operation. The determination is output to the controller processor 507, which controls the alternate frequency searching process based upon the determination. When the signal quality of a main frequency and corresponding alternate frequencies is less then a preset value, the receiver 500 determines whether to perform a seek operation based upon the program information code of the current frequency, reducing the frequency of the seek operation.

Figure 6:
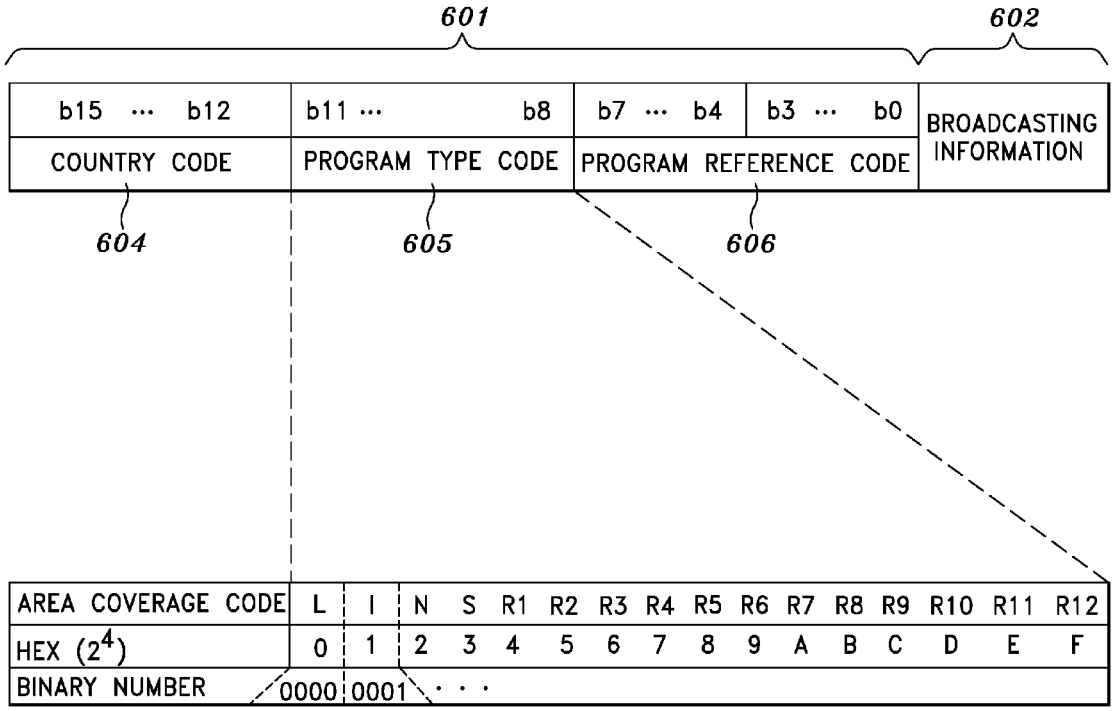
FIG. 6 depicts the arrangement of data in a program information code.

FIG. 6 depicts the arrangement of data in a program information code. The program information code is used to determine whether the seek operation should occur. Each broadcast program is assigned a sixteen bit program information code that discriminates one program from another. Each transmitted frame of a radio broadcast includes a 16-bit program information code 601 and 88-bits of broadcasting information 602. The first four bits 604 of the program information code 601, referred to as the first nibble (bits b15 to b12), represent the country code. The country code is indicative of the nation where the broadcasting station is located. The second four bits 605 of the program information code 601, referred to as the second nibble (bits b11 to b8), represent the program type code. The program type code is indicative of the regional range of the broadcast. The last eight bits 606 of the program information code 601, referred to as the third and fourth nibbles (bits b7 to b0), represent a program reference code. The program reference code uniquely identifies the program itself.

The second four bits 605 of the program information code 601 discriminate among sixteen regional ranges. For example, the second four bits 605 may store a local code ("L") indicative of a local program, an international code ("I") indicative of an international program, a national code ("N") indicative of a national program, a supra-regional code ("S") indicative of a program with applicability above regional applicability, or regional codes ("R1" to "R12") indicative of regional programs for specified regions. For example, the second four bits 605 of the program information code 601 of a local program would store "0000", which corresponds to the local code "L." The second four bits 605 of the program information code 601 of an international program would store "0001", which corresponds to the international code "I."

A local program ("L") is defined as a program which, during the entire program, is transmitted by one transmitter only. An international program ("I") is a program which is transmitted to a different country, a national program ("N") is a program which is transmitted throughout the same country, a supra-regional program ("S") is a program which is transmitted throughout a large part of the country, and regional programs ("R1" to "R12") are programs that are available in certain regions over one or more frequencies, where the boundaries of the broadcast are not necessarily based upon national borders. Based upon the second four bits 605 of the program information code 601, it is possible to determine whether it is likely that a program is broadcast over a neighboring region. When it is likely that the same program is being broadcast on another frequency besides the stored alternate frequencies, the seek operation is performed.

Figure 7:
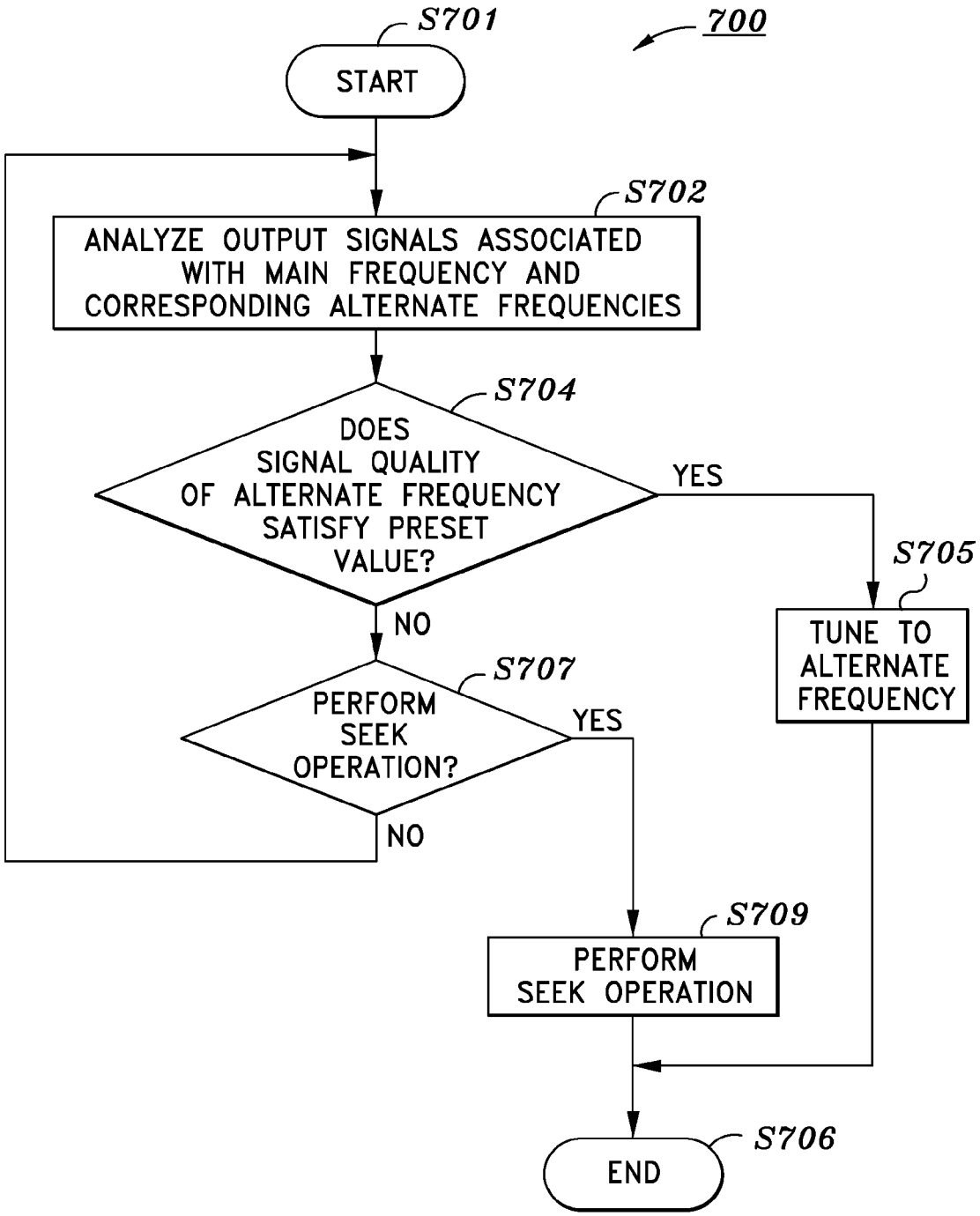
FIG. 7 is a flowchart depicting an exemplary method for searching for an alternate frequency.
Figure 8A:
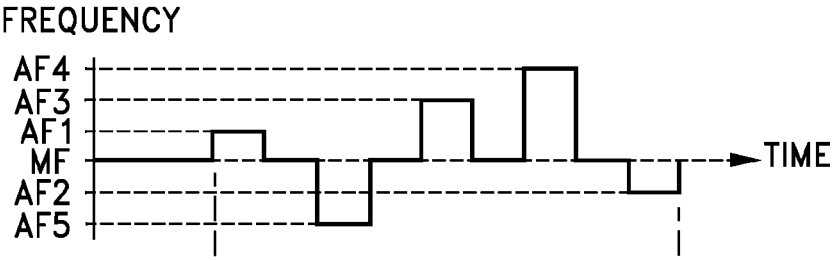
FIGS. 8A to 8E depict frequency searching using the exemplary method illustrated in FIG. 7.
Figure 8B:
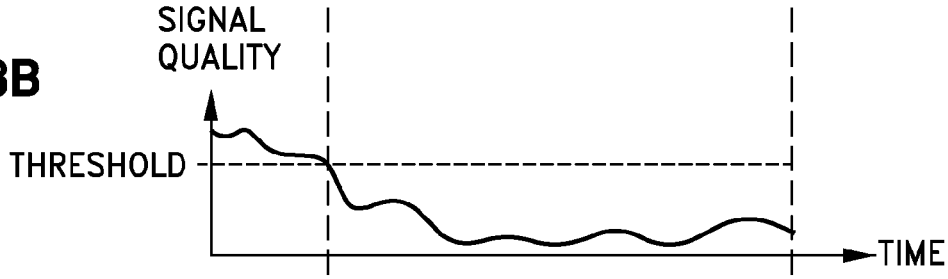

FIG. 7 is a flowchart depicting an exemplary method 700 for searching for an alternate frequency, and FIGS. 8A to 8E depict searching using the exemplary method 700. In FIG. 8A, a main frequency ("MF") has five corresponding alternate frequencies ("AF1" to "AF5"). The method 700 begins (S701) when power is applied to the receiver, or a user sets a frequency via a user input, such as via the input unit 401. When the program information code of a program received via the main frequency changes, or when the signal quality of the main frequency becomes less than a preset value, an alternate frequency is sought. The program information of a program received on a main frequency may change when a receiver mounted in a vehicle travels from one region to another.

The output signals associated with the main frequency and the corresponding alternate frequencies are analyzed using controller 405 (FIG. 7, S702; and FIG. 8A). In one example, the controller processor 416 of the receiver 400 receives an alternate frequency list stored in the storage medium 414, and tunes the tuner 402 to the main frequency and each of the corresponding alternate frequencies. The tuned broadcast signals are output to the broadcast signal processor 404. The processed signals are output to the controller 405, which analyzes the signal quality of each of the tuned frequencies.

Figure 8C:
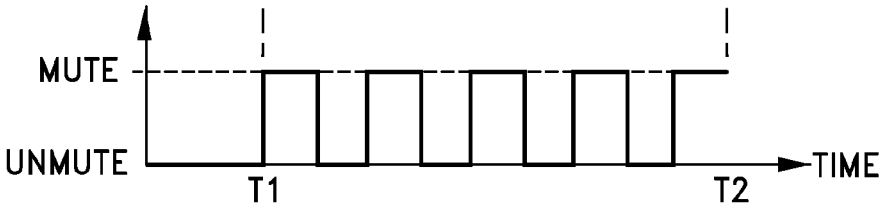

The signal quality of tuned signals is measured based upon comparing the signal-to-noise ratio ("SNR") or bit error rate ("BER") of the tuned signals to a preset value. As illustrated in FIG. 8C, the speaker 411 is muted during the process of searching to prevent the output of unwanted noises. During the signal quality check, it is determined whether any of the corresponding alternate frequencies have a signal quality which is equal to or greater than the preset value (S704). If the signal quality of one of the alternate frequencies satisfies the preset value (S704), the tuner is adjusted to tune that alternate frequency, to receive the broadcast of the desired program (S705), and the method 700 ends (S706). In one example, the controller 405 sets the tuner 402 to receive the alternate frequency.

If the signal quality of none of the alternate frequencies satisfies the preset value (S704), a determination is made as to whether to perform the seek operation (S707). The determination may be based upon the second four bits of the program information code of the main frequency and/or the alternate frequency completion flag. When the second four bits of the program information code is indicative of an international or national code, or when the second four bits of the program information code is not indicative of an international or national code but where the alternate frequency list completion flag is not set, it is appropriate to perform the seek operation. When the second four bits of the program information is indicative of an international or national code and the alternate frequency list completion flag is set, it is not appropriate to perform the seek operation.

Figure 8D:
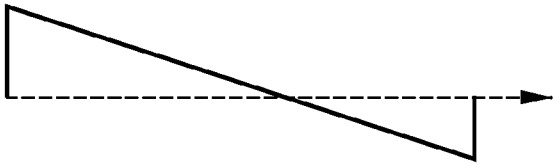
Figure 8E:
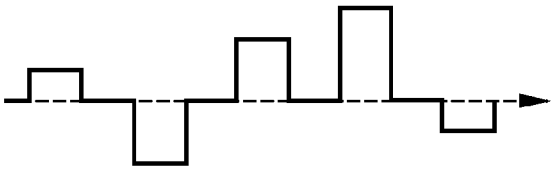

If it is determined that a seek operation is appropriate (S707), the seek operation is performed (S709), and the method 700 ends (FIG. 7, S706; FIG. 8D). If it is determined that a seek operation does not need to be performed (S707), the receiver continues to search the main frequency and corresponding alternate frequencies for the program (FIG. 7, S702; FIG. 8E).

Figure 9:
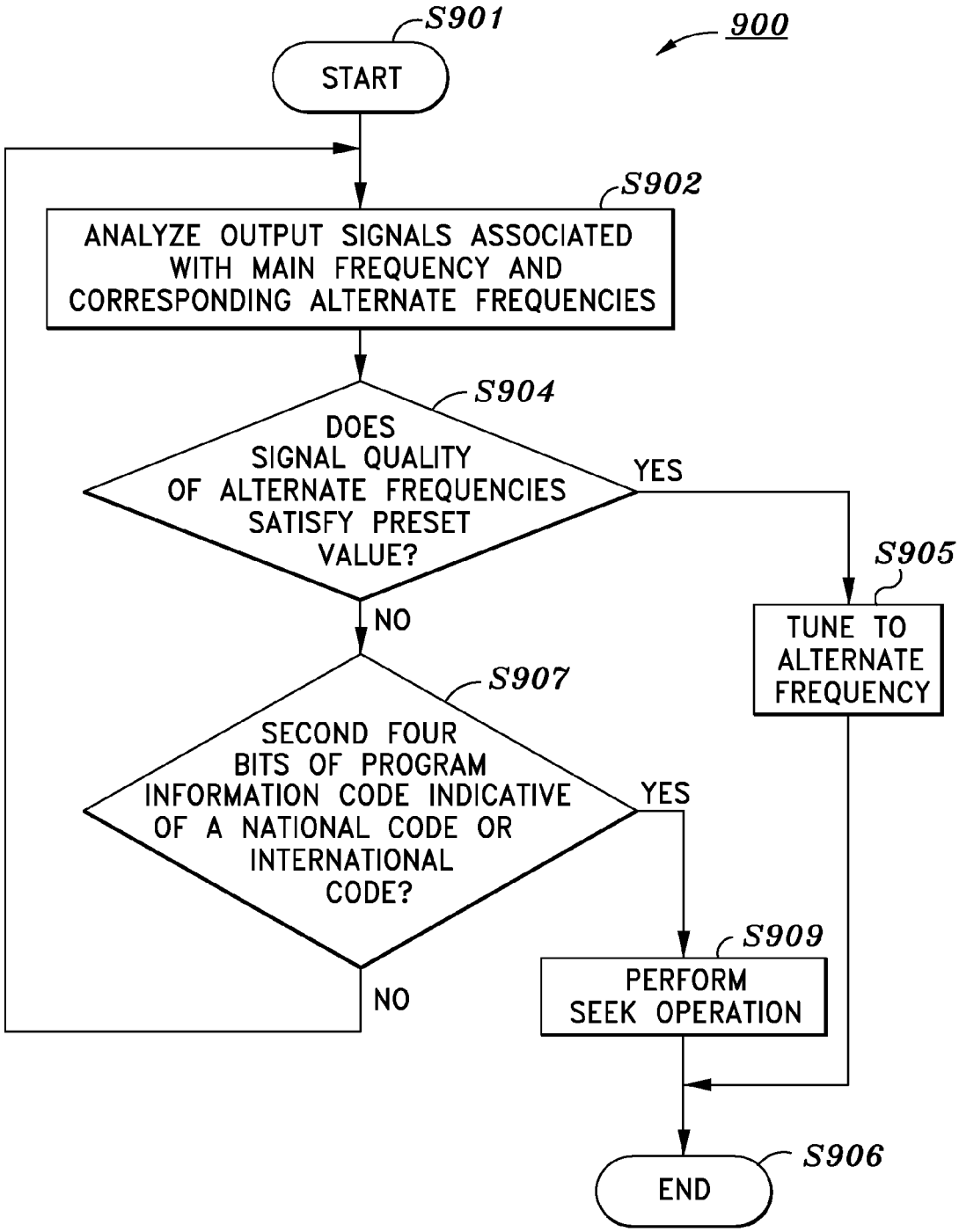
FIG. 9 is a flowchart depict an exemplary method for determining whether to perform a seek operation.

FIG. 9 is a flowchart depicting an exemplary method 900 for determining whether to perform a seek operation. The method 900 uses the second four bits of the program information code to determine whether to perform the seek operation, based upon the likelihood that the same program is broadcast in a neighboring region. In one example, controller 501 of the receiver 500 analyzes the program information of the main frequency to determine whether to perform the seek operation based upon whether the second four bits are indicative of a national code or a national code.

When the method 900 begins (S901), the output signals associated with the main frequency and corresponding frequencies are analyzed to determine if the output signals satisfy the preset value (S902). If it is determined that the signal quality of one of the alternate frequencies satisfies the preset value (S904), the tuner tunes to the alternate frequency that satisfies the preset value (S905), and the method 900 ends (S906).

If it is determined that none of the corresponding alternate frequencies satisfies the preset value (S904), it is determined whether the second four bits of the program information code are indicative of a national code or an international code (S907). If the second four bits of the program information code are indicative of a national code or an international code (S907), a seek operation is performed (S909), and the method 900 ends (S906). If the second four bits of the program information code are not indicative of a national code or an international code (S907), the signal quality of the main frequency and the alternate frequencies are again checked instead of performing a seek operation (S902).

FIGS. 10A to 10C illustrate exemplary alternate frequency list structures. In FIG. 10A, the alternate frequency list 1000 includes a header portion 1001 storing the total number, or quantity of alternate frequencies within the list, and corresponding alternate frequencies 1002. According to one implementation, and as illustrated in FIG. 10B, the alternate frequency list 1004 stores one instance of each alternate frequency. In another implementation, and as illustrated in FIG. 10C, the alternate frequency list 1005 may include duplicate instances of a corresponding alternate frequency, and may include a list of main frequency-alternate frequency pairs.

When a previously-received alternate frequency list does not coincide with a newly-received alternate frequency list, the receiver may perform a seek operation in order to search for an alternate frequency regardless of the program information code. In this instance, a likelihood exists that a new alternate frequency exists in a region neighboring the receiver. An alternate frequency completion flag may be set to confirm when a previously-received alternate frequency list coincides with a newly-received alternate frequency list.

Figure 11:
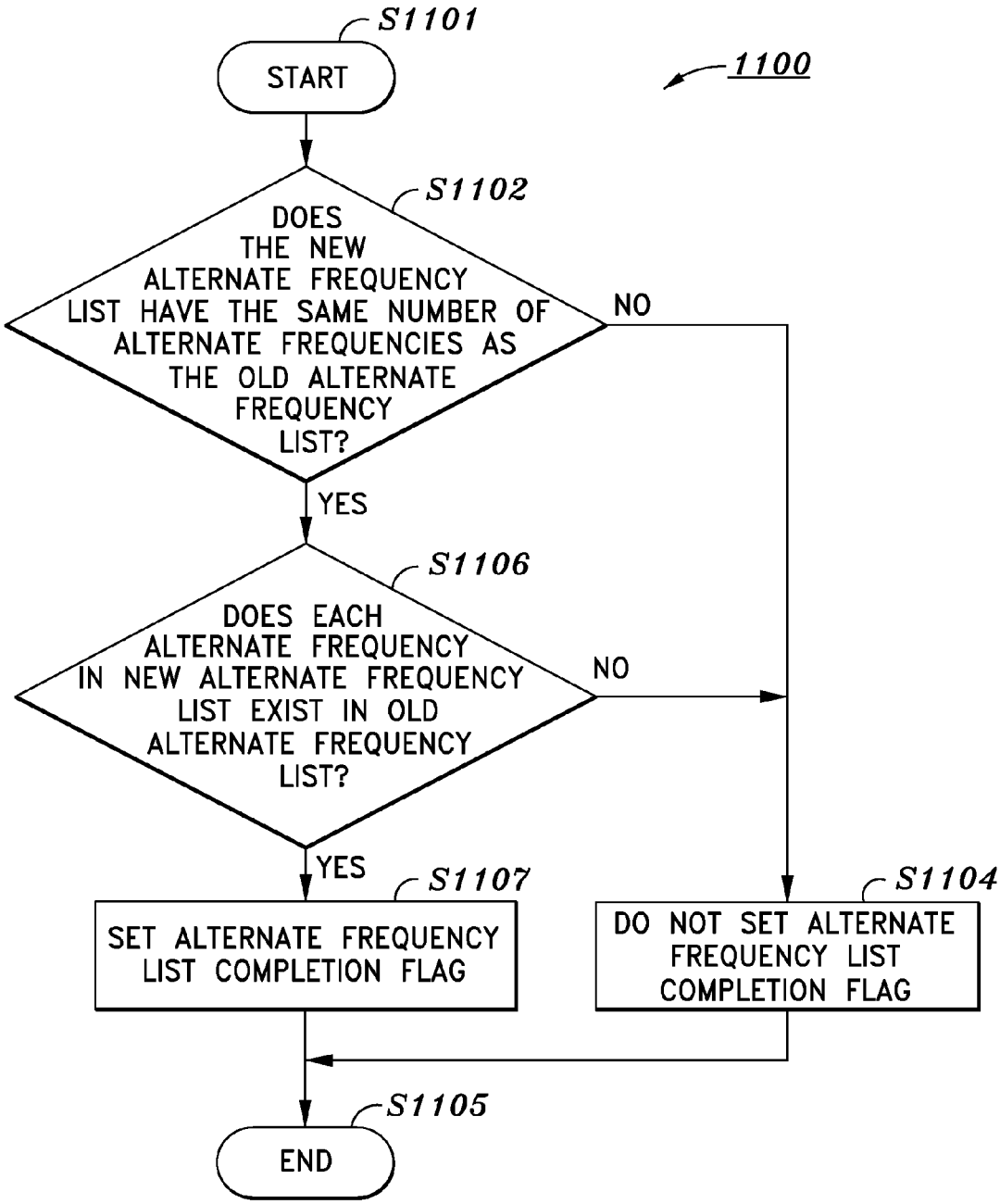
FIG. 11 is a flowchart depicting an exemplary method for setting an alternate frequency list completion flag.

FIG. 11 is a flowchart depicting an exemplary method 1100 for setting an alternate frequency list completion flag. The method 1100 begins (S1101) when a new alternate frequency list is received. A determination is made as to whether the new alternate frequency list includes the same number of alternate frequencies as the old alternate frequency list (S1102). If the new alternate frequency list has a different number of alternate frequencies (S1102), the alternate frequency list completion flag is not set (S1104), and the method 1100 ends (S1105).

If the number of alternate frequencies in the new alternate frequency list is the same as the number of alternate frequencies in the old alternate frequency list (S1102), it is determined whether each of the individual alternate frequencies stored in the new alternate frequency list exists in the old alternate frequency list (S1106). If any alternate frequency in the new alternate frequency list does not exist in the old alternate frequency list (S1106), the alternate frequency list completion flag is not set (S1104), and the method 1100 ends (S1105).

If each of the alternate frequencies in the new alternate frequency list exists in the old alternate frequency list (S1106), the alternate frequency completion flag is set (S1107), and the method 1100 ends (S1105). In one particular example, the controller 501 of the receiver 500 determines whether to set the alternate frequency completion flag in the storage medium 414.

Figure 12:
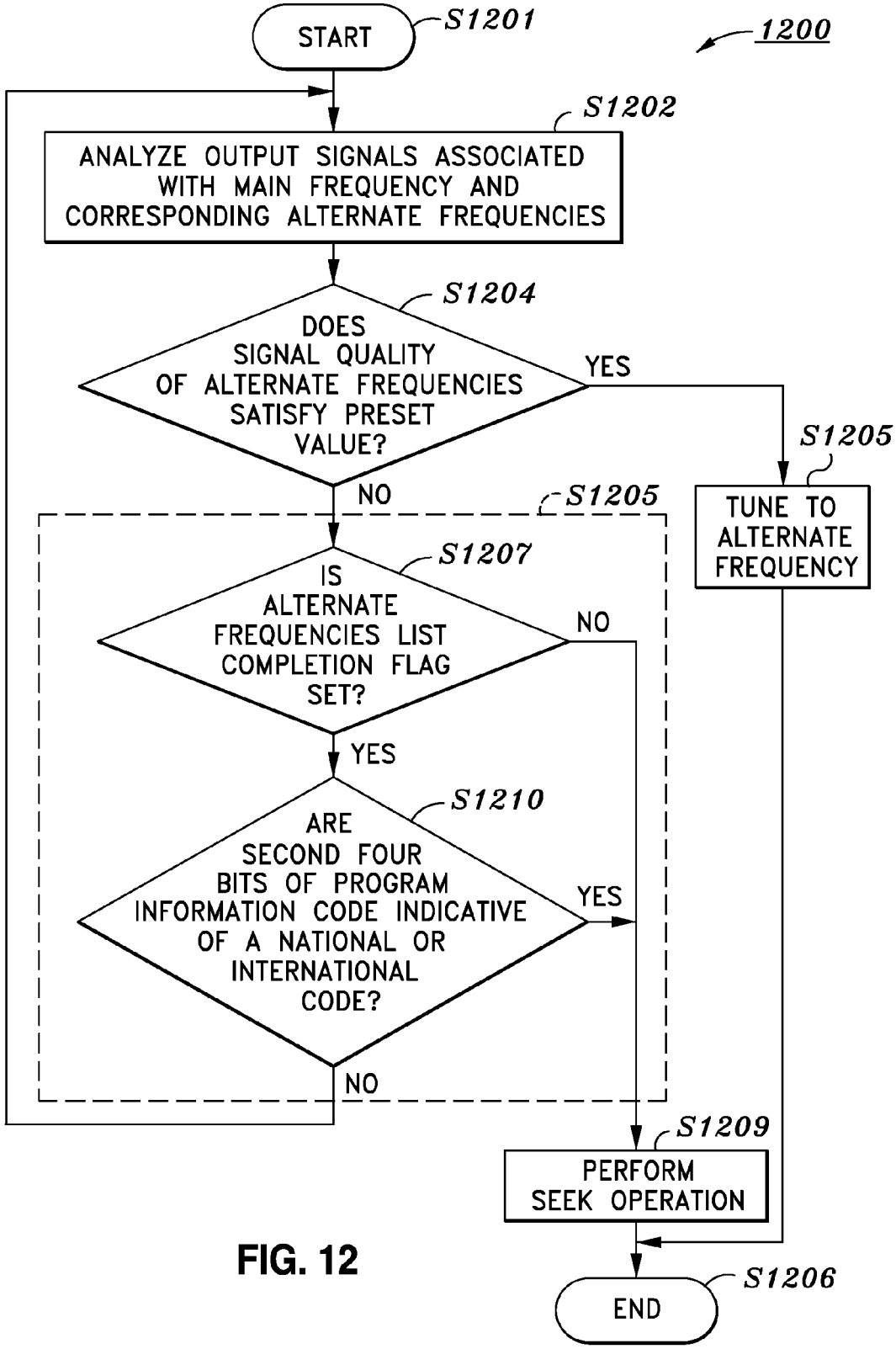
FIG. 12 is a flowchart depicting an exemplary method for searching for an alternate frequency.

FIG. 12 is a flowchart depicting an exemplary method 1200 of searching for an alternate frequency. When the method 1200 begins (S1201), the output signals associated with the main frequency and corresponding frequencies are analyzed to determine if the output signals satisfy the preset value (S1202). If it is determined that the signal quality of one of the alternate frequencies satisfies the preset value (S1204), the tuner tunes to the alternate frequency that satisfies the preset value (S1205), and the method 1200 ends (S1206).

If it is determined that the signal quality of none of the alternate frequencies satisfies the preset value (S1204), a determination is made as to whether the alternate frequency list completion flag is set (S1207). If the alternate frequency list completion flag is not set (S1207), there is a possibility that an alternate frequency exists which is broadcasting the same program, so a seek operation is performed (S1209), and the method 1200 ends (S1206).

If the alternate frequency list completion flag is set (S1207), the second four bits of the program information code are analyzed to determine whether they are indicative of a national code or an international code (S1210). If the second four bits of the program information code are indicative of a national code or an international code (S1210), a seek operation is performed (S1209), and the method 1200 ends (S1206). If the second four bits of the program information code are not indicative of a national code or an international code (S1210), the output signals associated with the main frequency and corresponding alternate frequencies are again analyzed to determine whether they satisfy the preset value, instead of performing the seek operation (S1202). Accordingly, when the receiver detects that the signal quality of tuned signals is less than a preset value, the receiver selectively performs a seek operation depending upon whether the program information code is indicative of a national code or an international code, and/or whether an alternate frequency completion list flag is set, so that the number of seek operations is reduced.

Figure 13:
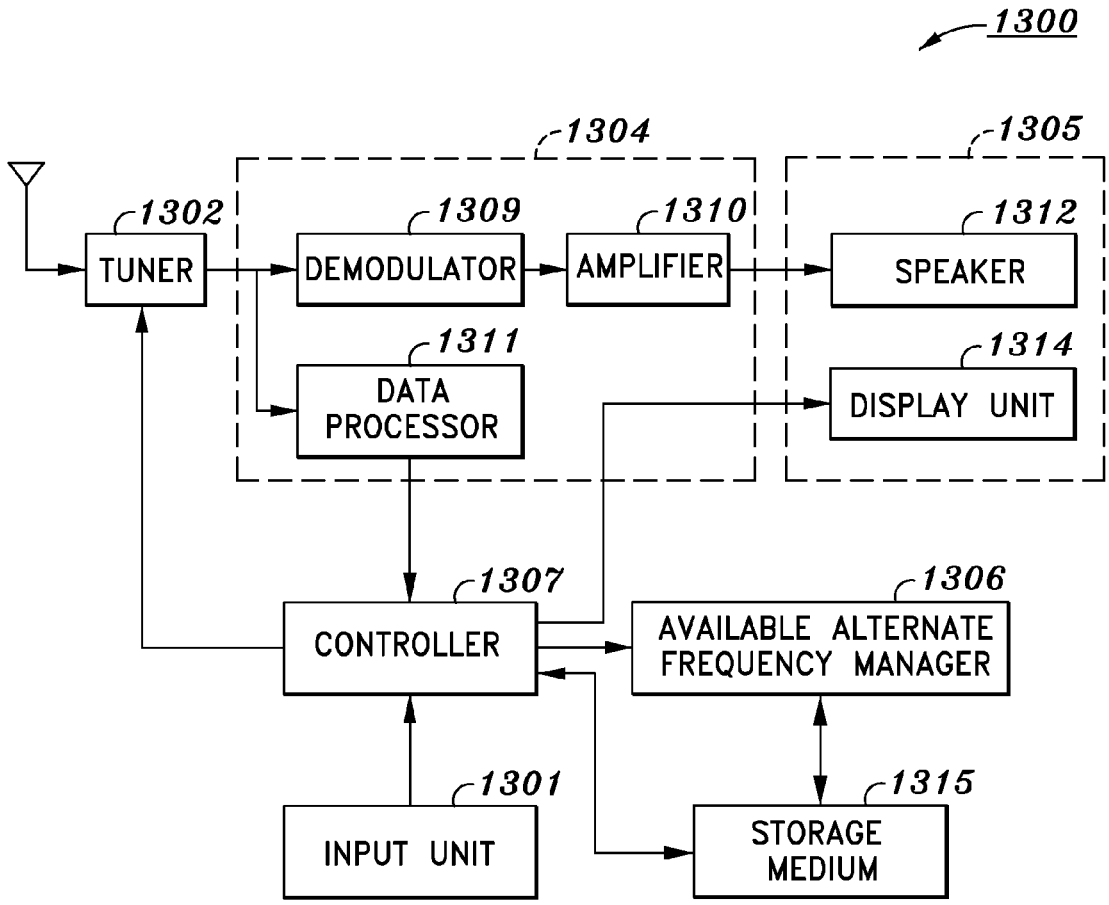
FIG. 13 is a block diagram depicting an exemplary receiver.

FIG. 13 is a block diagram of an exemplary receiver 1300, including an input unit 1301 for receiving a user input, a tuner 1302 for receiving radio broadcasts, and a broadcast signal processing unit 1304 for processing signals from the tuner 1302 such that the output signals are suitable for an output unit 1305. The receiver 1300 also includes an available alternate frequency manager 1306 for managing information regarding available alternate frequencies, and a controller 1307 for controlling each part of the receiver 1300 according to the user input, and for controlling a seek operation using the information regarding available alternate frequencies when the quality of received signals is less than a preset value.

The input unit 1301 is designed for receiving user input from the user. The user input is a control command for operating the receiver 1300 and for selecting a channel through which a desired program is broadcast. The input unit 1301 includes keys, buttons or controls provided on a surface of the receiver adjacent to the user, or includes or a radio input unit such as a remote control. The tuner 1302 detects radio signals, such as RDS composite signals, which are broadcast through a predetermined channel selected via the input unit 1301, and outputs tuned signals to the broadcast signal processing unit 1304 in response to receiving a control signal from the controller 1307.

The broadcast signal processing unit 1304 includes a demodulator 1309 for demodulating the tuned signals from the tuner 1302 and for outputting audio signals. The broadcast signal processing unit 1304 also includes an amplifier 1310 for amplifying audio signals received from the demodulator 1309. Furthermore, the broadcast signal processing unit 1304 also includes a data processor 1311 for extracting data from the tuned signals output from the tuner 1302 and for providing the extracted data to the controller 1307.

The output unit 1305 includes a speaker 1312 for outputting the amplified audio signals received from the amplifier 1310 in the form of audible sound waves, and a display unit 1314 for displaying character information corresponding to extracted data output from the data processor 1311, which is controlled by the controller 1307. A storage medium 1315 may further include a flash memory that can read and write data to store program data required for an operation of the receiver 1300, and broadcast program information-related data such as alternate frequency information.

The available alternate frequency manager 1306 stores a list of available alternate frequencies. The available alternate frequency manager 1306 is utilized when it is determined that the program information of a program broadcast via frequencies whose broadcast signals satisfy a preset value does not match the program information of a program broadcast through a current frequency. In one implementation, the available alternate frequency manager 1306 exists in a predetermined region of a memory space of the storage medium 1315. In another implementation, the available alternate frequency manager 1306 is a separate device from storage medium 1315.

The controller 1307 controls each part of the receiver 1300 according to the user input received by the user via the input unit 1301. In particular, the controller 1307 detects an output level of the demodulator 1309 or an output level of the data processor 1311, and controls a seek operation using available alternate frequency information when the output of the receiver 1300 is less than a preset value, such as when the quality of received broadcasting signals is degraded.

Figure 14A:
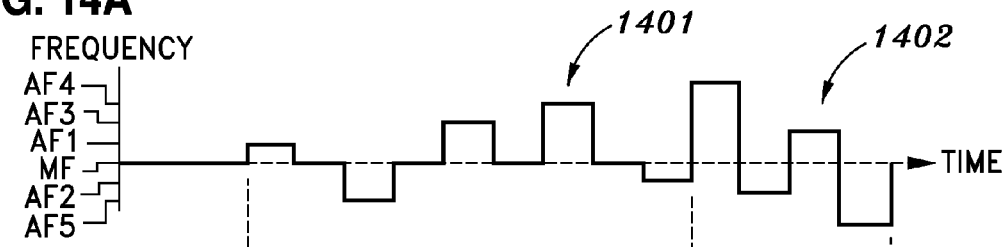
FIGS. 14A to 14E depict frequency searching using an exemplary receiver.

FIGS. 14A to 14E illustrate frequency searching using the exemplary receiver 1300. In FIG. 14A, a main frequency and five alternate frequency (referred to as AF1 to AF5) are represented in region 1401, and other alternate frequencies from the list of available alternate frequencies are illustrated in region 1402. The list of available alternate frequencies is utilized if it is determined that the program information of the main frequency does not match the program information of the alternate frequencies AF1 to AF5, even when alternate frequencies AF1 to AF5 satisfy the preset value.

Figure 14B:
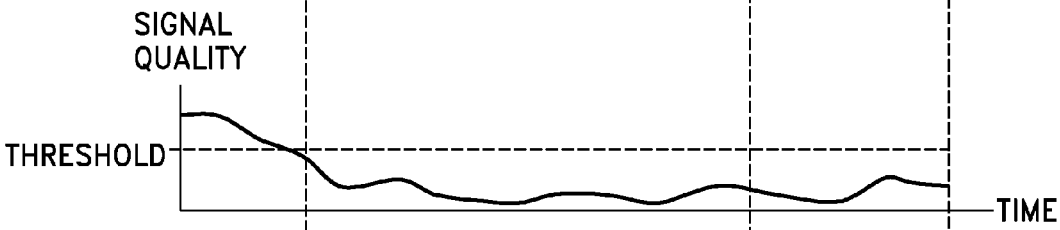

When the program information of the program broadcast on the main frequency changes, such as, for example, when a receiver is disposed in a vehicle which travels from one city to another city, or when the quality of received signals considerably declines (as illustrated in FIG. 14B), it is preferable to switch to an alternate frequency. In order to switch to an alternate frequency, a decision is made as to whether to use one of the five alternate frequencies (AF1 to AF5), to consult the list of available alternate frequencies, or to perform a seek operation.

Figure 14C:
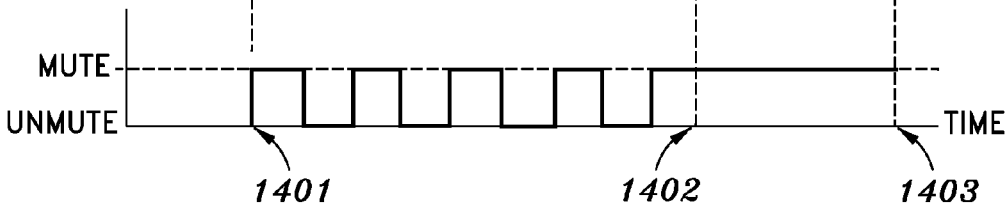
Figure 14D:
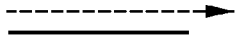

As illustrated in FIG. 14C, the receiver tunes to each of the alternate frequencies AF1 to AF5. If none of the alternate frequencies satisfy the preset value, the list of available alternate frequencies is consulted. As shown in FIG. 14D, when one of the available alternate frequencies from the list of available alternate frequencies satisfies the preset value, the program information code of the available frequency is checked.

Figure 14E:
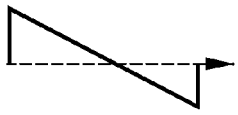

As shown in FIG. 14E, when none of the available alternate frequencies of list of available alternate frequencies satisfies the preset value, a seek operation is performed. The system is muted during the searching of the alternate frequencies (times 1401 to 1402), and during the searching of the available frequencies from the list of available alternate frequencies (times 1402 to 1403).

Figure 15:
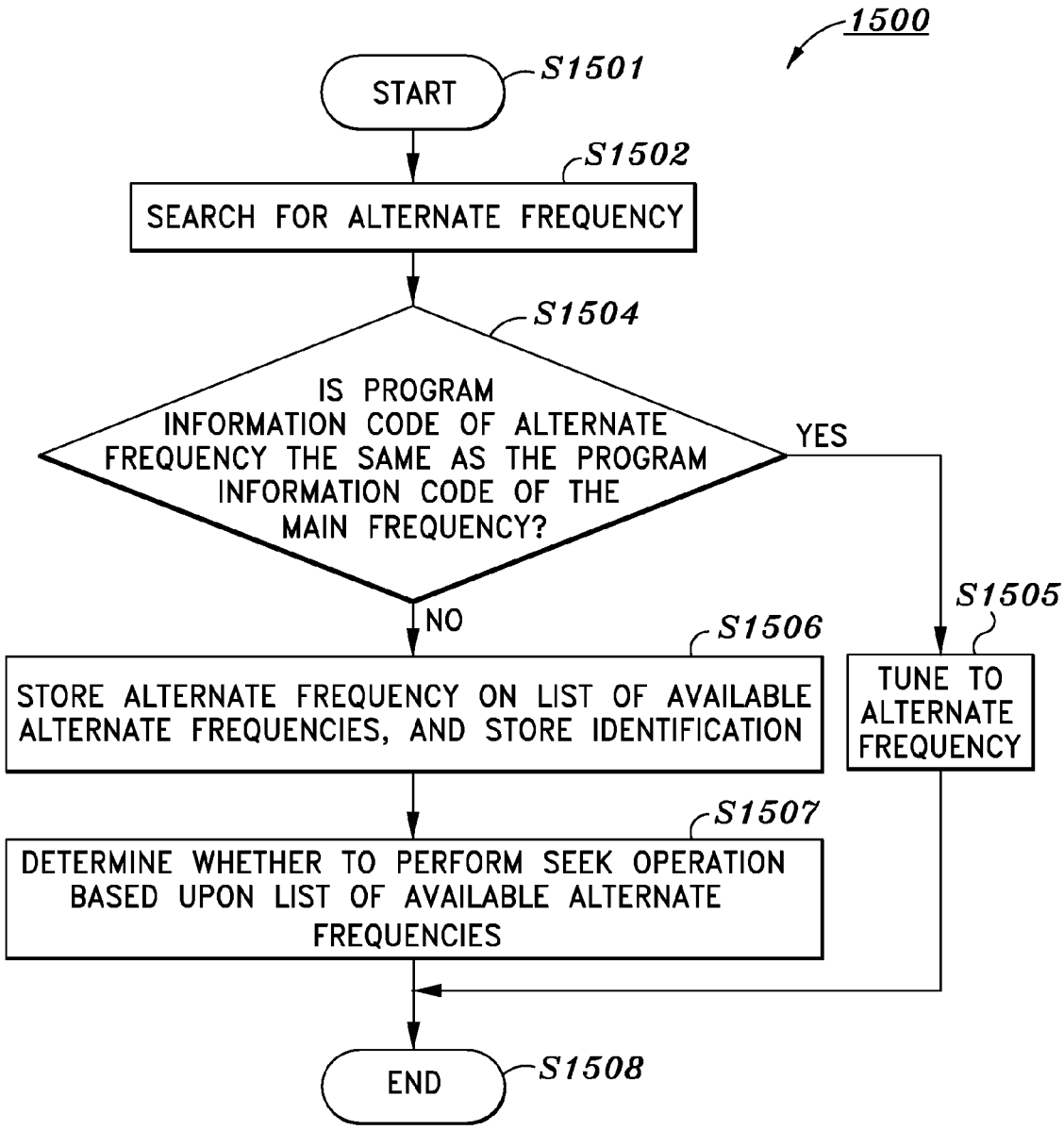
FIGS. 15, 16, 16A, 16B, 17, 17A, 17B, 18, 18A and 18B are flowcharts depicting exemplary methods for searching for an alternate frequency.

FIG. 15 is a flowchart depicting an exemplary method 1500 for searching for an alternate frequency. When a search is conducted for an alternate frequency from the list of available alternate frequencies, an identification of the alternate frequency is stored, and the stored information is used to control the alternate frequency searching process. In more detail, the method 1500 begins when a receiver initiates an alternate frequency switching operation (S1501). A search is performed for an alternate frequency which satisfies a preset signal quality value (S1502). When an alternate frequency is found whose signals satisfy a preset reference value, the program information code of the corresponding alternate frequency is checked to determine whether the program broadcast on the alternate frequency is the same as the program broadcast on the main frequency (S1504).

When the program code of the alternate frequency is the same as the program code of the main frequency (S1504), the receiver tunes to the alternate frequency (S1505) to provide service to the program the alternate frequency. If the program code of the alternate frequency is different from the program code of the main frequency (S1504), the alternate frequency is stored on a list of available alternate frequencies, and an identification of the alternate frequency is also stored, such as in a controller (S1506).

Accordingly, when the program information of the main frequency changes, or when the quality of received signals declines and necessitates tuning to an alternate frequency, each alternate frequency is checked. When the signal quality of each alternate frequency is not greater than a preset value, then the alternate frequencies in the list of available alternate frequencies is checked.

If one of the alternate frequencies in the list of available alternate frequencies has a signal strength which is greater than the preset value, the program information code is checked to determine whether it is the same as the program information code on the main frequency. If the program codes match, the alternate frequency in the list of available alternate frequencies is tuned. If none of the alternate frequencies in the list of available alternate frequencies has the same program information code, a seek operation is performed. In this regard, when it is necessary to switch from the main frequency, the list of available alternate frequencies is used to determine whether to perform a seek operation (S1507), and the method 1500 ends (S1508).

Figures 16, 16A:
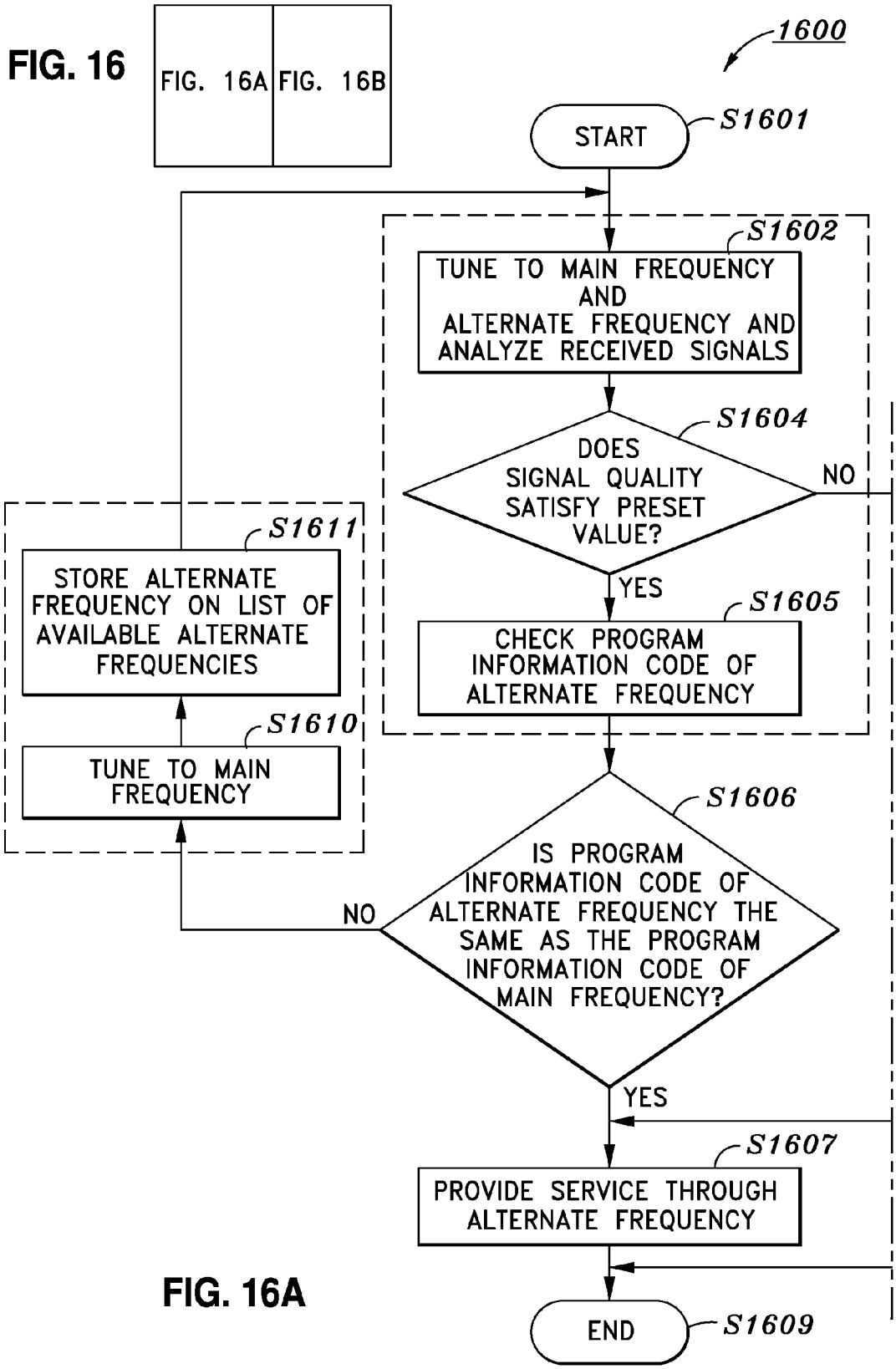
Figure 16B:
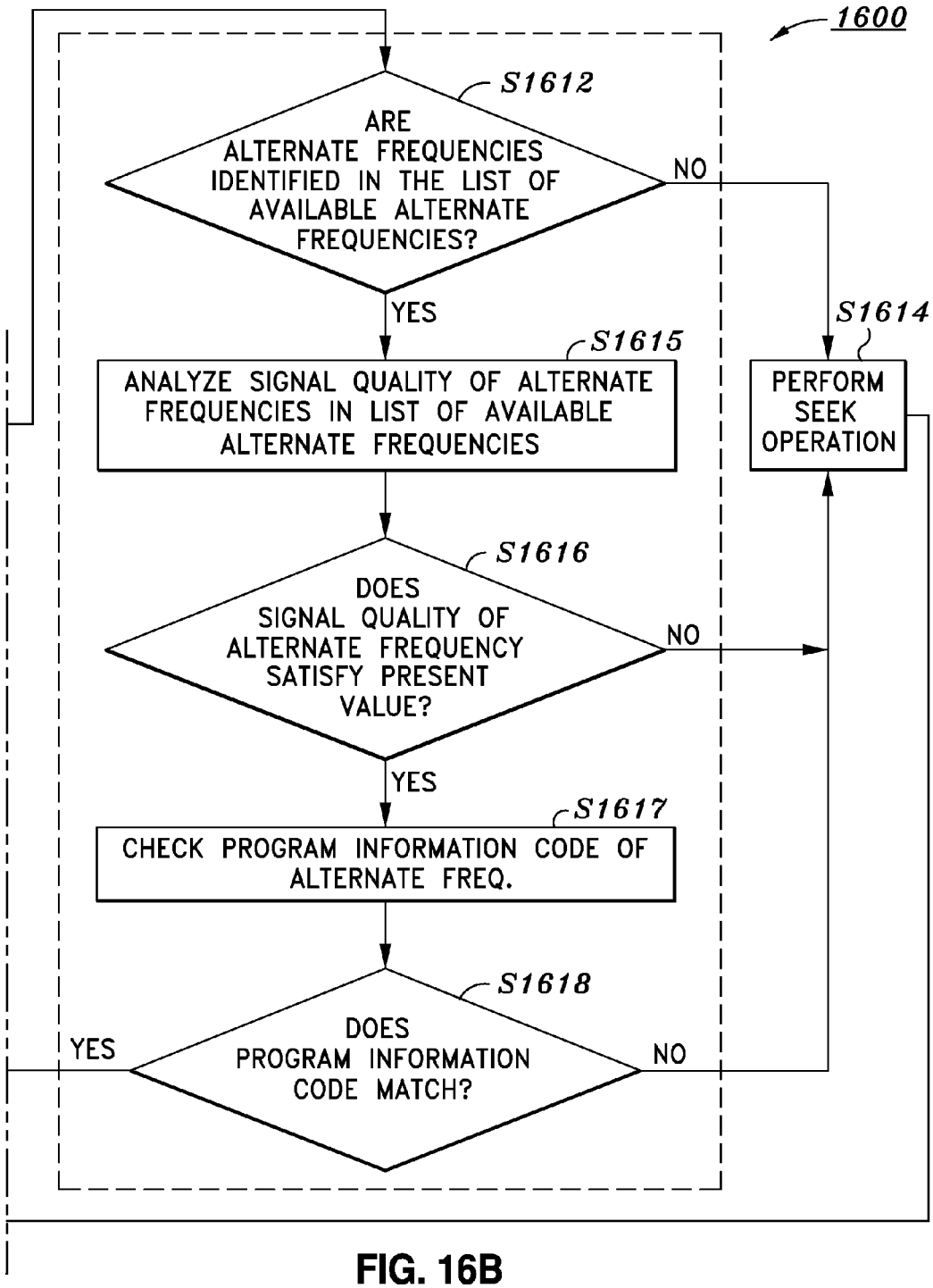

FIGS. 16, 16A and 16B provide a flowchart depicting an exemplary method 1600 for searching for an alternate frequency. The method 1600 begins when the program information code of a main frequency through which a program is currently received changes, or when the quality of received signals considerably reduces during reception, thus necessitating a switch to an alternate frequency (S1601). A controller checks the signal quality of signals broadcast through the main frequency and alternate frequencies stored in a storage medium (S1602).

The controller, such as the controller 1307, reads the alternate frequencies stored in the storage medium, such as the storage medium 1315, and tunes the tuner to the main frequency and each of the alternate frequencies. The broadcast signals detected on each alternate frequency are output to a broadcast signal processor, such as the broadcast signal processor 1305. The controller analyzes an output level of signals output from the broadcast signal processor that are received via the alternate frequencies, by checking the signal quality of each signal, where signal quality is determined, for example based on whether the SNR or BER of the received signals is greater than a preset value.

The output of the receiver is muted in order to prevent the output of unwanted noise while each of the alternate frequencies is being searched. The signal quality of the main frequency and each of the alternate frequencies is checked, and a determination is made as to whether the signal quality of any of the alternate frequencies satisfies a preset value (S1604). If the signal quality of any of the alternate frequencies satisfies the preset value, the controller checks the program information code of the alternate frequency (S1605). If the program information code of the alternate frequency is the same as the program information code of the main frequency (S1606), the controller controls the tuner to tune to the alternate frequency and service the program broadcast through the alternate frequency (S1607), and the method 1600 ends (S1609).

When the program information code of the alternate frequency is not the same as the program information code of the main frequency (S1606), the controller controls the tuner to tune to the main frequency (S1610), and the alternate frequency is stored on a list of available alternate frequencies (S1611). The list of available alternate frequencies is used to determine whether to perform a seek operation when the receiver does not find an alternate frequency through which high quality broadcast signals are received.

When none of the alternate frequencies has a signal quality that satisfies the preset value (S1604), the controller determines whether alternate frequencies are identified in the list of available alternate frequencies (S1612). When no alternate frequencies are identified in the list of available alternate frequencies (S1612), a seek operation is performed (S1614) and the method 1600 ends (S1609). However, when alternate frequencies are identified in the list of available alternate frequencies (S1612), the signal quality is analyzed for each of the alternate frequencies stored in the list of available alternate frequencies (S1615).

If the signal quality of none of the alternate frequencies in the list of available alternate frequencies satisfies the preset value (S1616), the seek operation is performed (S1614), and the method 1600 ends (S1609). If the signal quality of any of the alternate frequencies in the list of available alternate frequencies satisfies the preset value (S1616), the program information code of the program broadcast on the alternate frequency is checked against the program information code of the program broadcast on the main frequency (S1617).

If the program information code of the program broadcast on the alternate frequency matches the program information code of the program broadcast on the main frequency (S1618), the controller controls the tuner to tune to the alternate frequency in the list of available alternate frequencies to service the program broadcast through the alternate frequency (S1607), and the method 1600 ends (S1609). However, when the program information code of the program broadcast on the alternate frequency does not match the program information code of the program broadcast on the main frequency (S1618), the seek operation is performed (S1614), and the method 1600 ends (S1609). Accordingly, the seek operation may be performed less frequently, so as to reduce the inconvenience that a user of the receiver experiences.

Figure 17A:
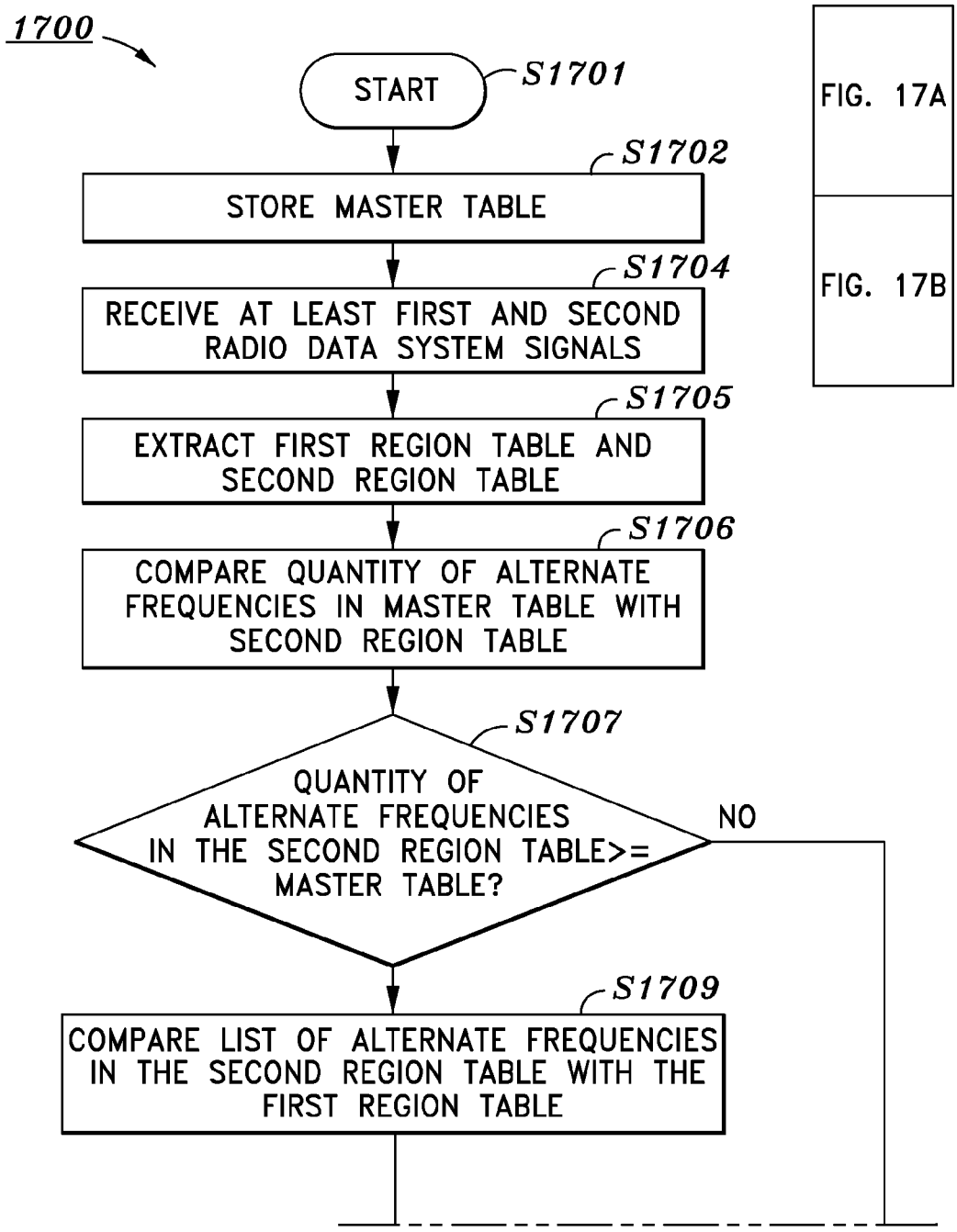
Figure 17:
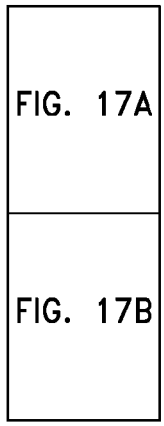
Figure 17B:
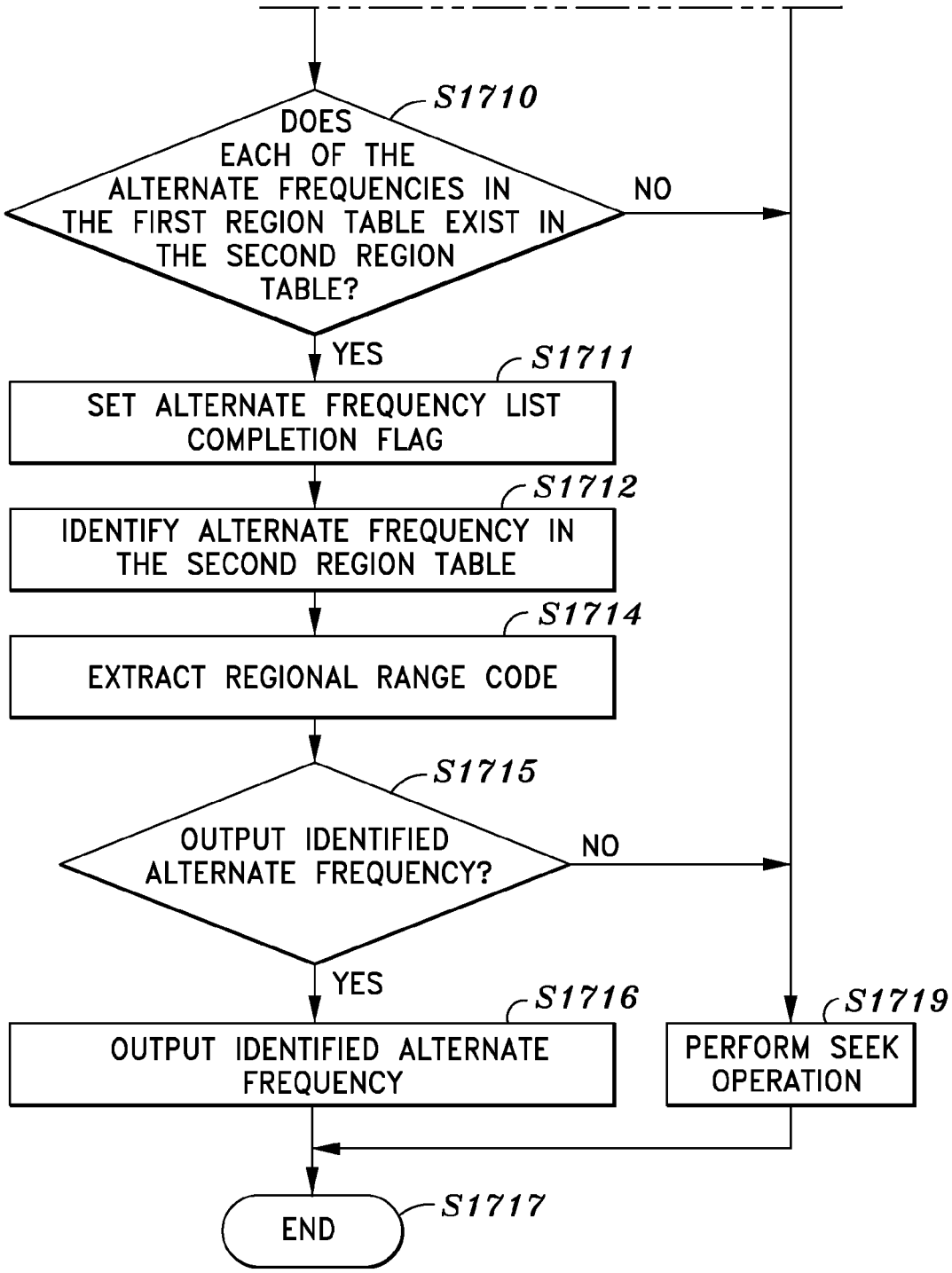

FIGS. 17, 17A and 17B provide a flowchart of another exemplary method 1700. The method 1700 begins (S1701), and a master table is stored (S1702). The master table includes a quantity of alternate frequencies associated with a main frequency for at least first and second regions. At least first and second radio data system signals are received (S1704), and a first region table is extracted from the first radio data system signal and a second region table is extracted from the second radio data system signal, with the first and second region tables each including a quantity of alternate frequencies and a list of alternate frequencies (S1705).

The quantity of alternate frequencies for the second region stored in the master table is compared with the quantity of alternate frequencies included in the second region table (S1706). The list of alternate frequencies included in the second region table is compared with the list of alternate frequencies included in the first region table (S1709) if the quantity of alternate frequencies included in the second region table is equal to or greater than the quantity of alternate frequencies for the second region stored in the master table (S1707). If the quantity of alternate frequencies in the second region table is less than the quantity of alternate frequencies in the master table (S1707), a seek operation is performed (S1719), and the method 1700 ends (S1717).

If each of the alternate frequencies in the list of alternate frequencies included in the first region table exists in the second region table (S1710), an alternate frequency list completion flag is set (S1711), one of alternate frequencies included in the second region table is identified (S1712), and a regional range code is then extracted from the identified alternate frequency (S1714). An alternate frequency completion flag may be stored if each of the alternate frequencies in the list of alternate frequencies included in the first region table exists in the second region table. If each of the alternate frequencies in the list of alternate frequencies included in the first region table does not exist in the second region table (S1710), the seek operation is performed (S1719), and the method 1700 ends (S1717).

Once the regional range code has been extracted (S1714), a determination is made as to whether to output the identified alternate frequency (S1715). Determining whether to output the identified alternate frequency or perform the seek operation may be based upon the regional range code being indicative of an international code or a national code.

If each of the alternate frequencies in the list of alternate frequencies included in the first region table exists in the second region table (S1715), the alternate frequency is output (S1716). A seek operation is performed (S1719) if any of the alternate frequencies in the list of alternate frequencies included in the first region table does not exist in the second region table (S1710). In either case, the method 1700 ends (S1717)

Figures 18, 18A:
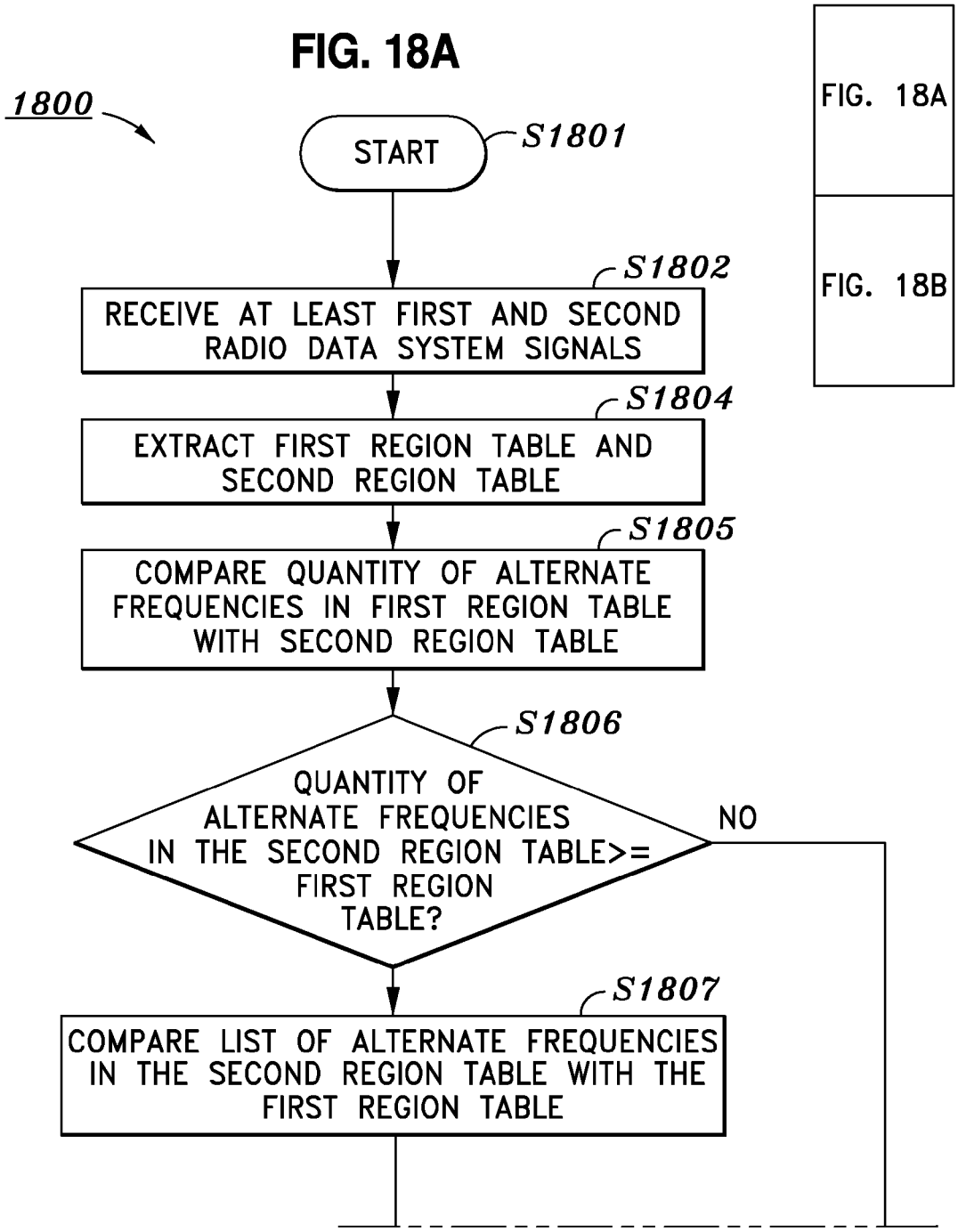
Figure 18B:
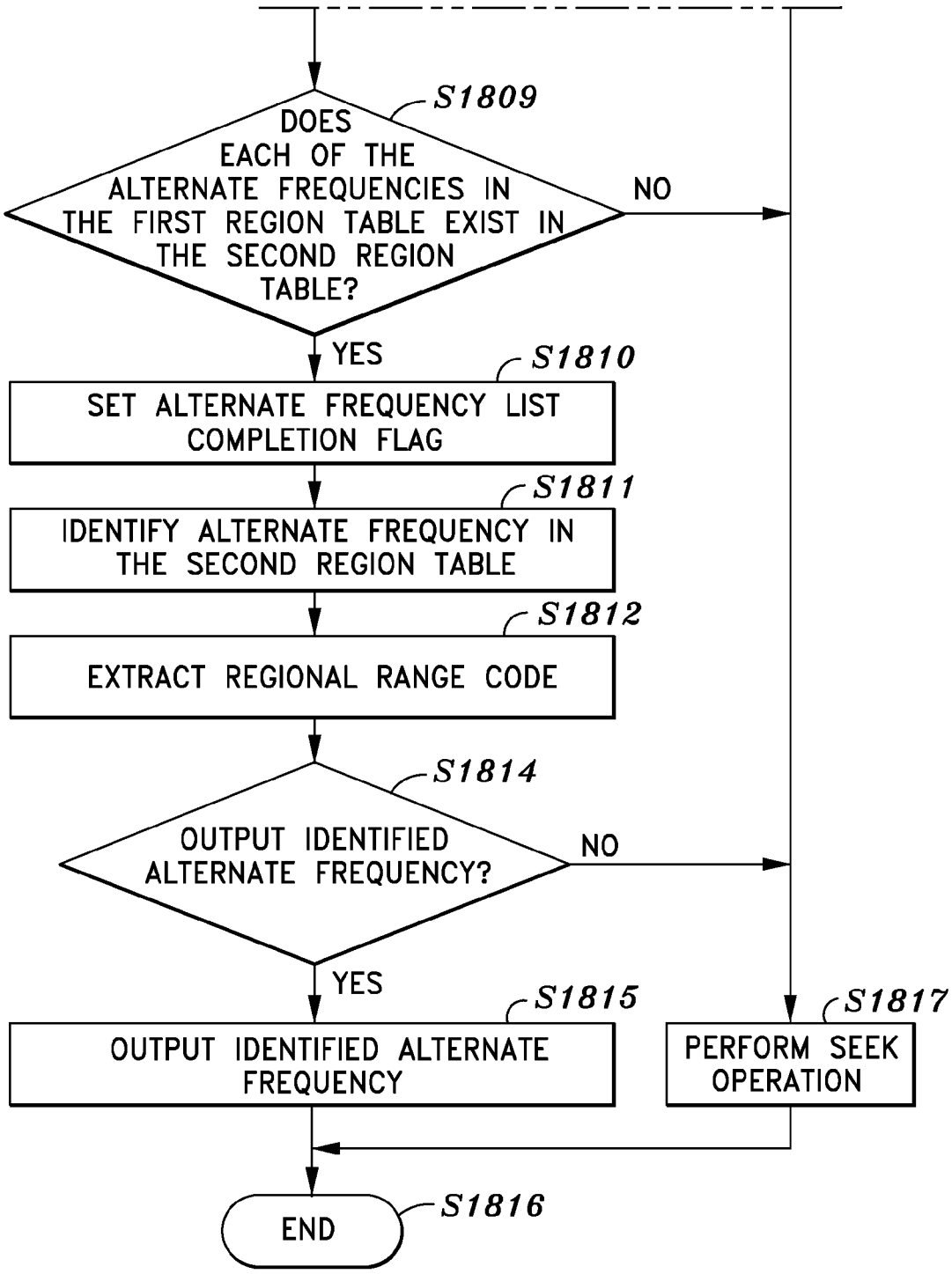

FIGS. 18, 18A and 18B provide a flowchart illustrating another exemplary method. When method 1800 begins (S1801), at least first and second radio data system signals are received (S1802). A first region table is extracted from the first radio data system signal and a second region table is extracted from the second radio data system signal (1804), with the first and second region tables each including a quantity of alternate frequencies and a list of alternate frequencies. The quantity of alternate frequencies included in the second region table is compared with the quantity of alternate frequencies included in the first region table (S1805). If the quantity of alternate frequencies in the second region table is less than the quantity of alternate frequencies in the first region table (S1806), a seek operation is performed (S1817) and the method 1800 ends (S1816).

If the quantity of alternate frequencies in the second region table is greater than or equal to the quantity of alternate frequencies in the first region table (S1806), the list of alternate frequencies included in the second region table is compared with the list of alternate frequencies included in the first region table (S1807). If any of the alternate frequencies in the first region table does not exist in the second region table (S1809), the seek operation is performed (S1817), and the method 1800 ends (S1816). If each of the alternate frequencies in the first region table exists in the second region table (S1809), an alternate frequency list completion flag is set (S1810), and one of the alternate frequencies included in the second region table is identified (S1811). After the alternate frequency is identified (S1811), a regional range code is extracted from the alternate frequency (S1812), and a determination is made as to whether to output the identified alternate frequency (S1814). A determination may be made as to whether the regional range code is indicative of an international code or a national code, where one of the alternate frequencies included in the second region table is determined to be output if the alternate frequency completion flag is stored and the regional range code is indicative of an international code or a national code. Alternatively, the seek operation may be performed if the alternate frequency completion flag is not stored, or if the alternate frequency completion flag is stored and the regional range code is not indicative of an international code or a national code.

If it is determined that the identified alternate frequency is to be output (S1814), the identified alternate frequency is output (S1815) and the method 1800 ends (S1816). If it is determined that the identified alternate frequency is not to be output, the seek operation is performed (S1817) and the method 1800 ends (S1816).

The arrangements have been described with particular illustrative implementations. It is to be understood that the concepts are not however limited to the above-described implementations and that various changes and modifications may be made.

What is claimed is:

1. A method comprising:

storing a master table including a quantity of alternate frequencies associated with a main frequency for at least first and second regions;

receiving at least first and second radio data system signals;

extracting a first region table from the first radio data system signal and a second region table from the second radio data system signal, the first and second region tables each including a quantity of alternate frequencies and a list of alternate frequencies;

comparing the quantity of alternate frequencies for the second region stored in the master table with the quantity of alternate frequencies included in the second region table;

comparing the list of alternate frequencies included in the second region table with the list of alternate frequencies included in the first region table if the quantity of alternate frequencies included in the second region table is equal to or greater than the quantity of alternate frequencies for the second region stored in the master table;

identifying one of the alternate frequencies included in the second region table if each of the alternate frequencies in the list of alternate frequencies included in the first region table exists in the second region table;

outputting the identified alternate frequency if each of the alternate frequencies in the list of alternate frequencies included in the first region table exists in the second region table;

performing a seek operation if any of the alternate frequencies in the list of alternate frequencies included in the first region table does not exist in the second region table;

extracting a regional range code from a radio data system signal; and determining whether to output the identified alternate frequency or perform the seek operation based upon the regional range code, wherein determining whether to output the identified alternate frequency or perform the seek operation is based upon the regional range code being indicative of an international code.

2. The method of claim 1, wherein determining whether to output the identified alternate frequency or perform the seek operation is based upon the regional range code being indicative of an international code or a national code.

3. The method of claim 1, further comprising storing an alternate frequency completion flag, wherein the alternate frequency completion flag is set if each of the alternate frequencies in the list of alternate frequencies included in the first region table exists in the second region table.

4. A method comprising:

receiving at least first and second radio data system signals;

extracting a first region table from the first radio data system signal and a second region table from the second radio data system signal, the first and second region tables each including a quantity of alternate frequencies and a list of alternate frequencies;

comparing the quantity of alternate frequencies included in the second region table with the quantity of alternate frequencies included in the first region table;

comparing the list of alternate frequencies included in the second region table with the list of alternate frequencies included in the first region table if the quantity of alternate frequencies included in the second region table is equal to or greater than the quantity of frequencies included in the first region table;

identifying one of the alternate frequencies included in the second region table if each of the alternate frequencies in the list of alternate frequencies included in the first region table exists in the second region table;

outputting the identified alternate frequency if each of the alternate frequencies in the list of alternate frequencies included in the first region table exists in the second region table;

performing a seek operation if any of the alternate frequencies in the list of alternate frequencies included in the first region table does not exist in the second region table; and storing an alternate frequency completion flag, wherein the alternate frequency completion flag is set if each of the alternate frequencies in the list of alternate frequencies included in the first region table exists in the second region table.

5. The method according to claim 4, further comprising:

extracting a regional range code from the radio data system signal; and determining whether the regional range code is indicative of an international code or a national code, wherein one of the alternate frequencies included in the second region table is output if the alternate frequency completion flag is stored and the regional range code is indicative of an international code or a national code, and wherein a seek operation is performed if the alternate frequency completion flag is not stored, or if the alternate frequency completion flag is stored and the regional range code is indicative of an international code.

6. The method according to claim 5, wherein the alternate frequency is based upon information found in a program information code and wherein a first four bits of the program information code referred to as a first nibble represent the country code, the second four bits of the program information code referred to as a second nibble represent the program type code in which the program type code is indicative of the regional range of the broadcast and eight bits of the program information code referred to as the third and fourth nibbles represent a program reference code in which the program reference code uniquely identifies the program itself

7. The method according to claim 4, further comprising:

analyzing, by a controller, a signal quality of an output signal of an alternate frequency associated with a main frequency that is output from a broadcast signal processing unit;

checking whether the signal quality of one of the alternate frequencies is greater than or equal to a preset value to determine whether a program which is being broadcast on the alternate frequency matches a program which is being broadcast on the main frequency;

adjusting from the main frequency to the alternate frequency if the same program is being broadcast on the alternate frequency;

excluding the corresponding alternate frequency from the list of the alternate frequencies if the same program is not being broadcast on the alternate frequency; and performing a seek operation except for the excluded alternate frequency.

8. The method according to claim 4, further comprising:

extracting a regional range code from the radio data system signal; and determining whether the regional range code is indicative of an international code or a national code, wherein one of the alternate frequencies included in the second region table is output if the alternate frequency completion flag is stored and the regional range code is indicative of an international code or a national code, wherein if the alternate frequency completion flag is stored and the regional range code is not indicative of an international code or a national code, performing, by at least one processor, operations comprising:

extracting a first region table from the first radio data system signal and a second region table from the second radio data system signal, the first and second region tables each including a quantity of alternate frequencies and a list of alternate frequencies, comparing the quantity of alternate frequencies for the second region stored in the master table with the quantity of alternate frequencies included in the second region table, comparing the list of alternate frequencies included in the second region table with the list of alternate frequencies included in the first region table if the quantity of alternate frequencies included in the second region table is equal to or greater than the quantity of alternate frequencies for the second region stored in the master table, identifying one of the alternate frequencies included in the second region table if each of the alternate frequencies in the list of alternate frequencies included in the first region table exists in the second region table, and outputting the identified alternate frequency if each of the alternate frequencies in the list of alternate frequencies included in the first region table exists in the second region table.

9. A device comprising:

a storage medium configured to store a master table including a quantity of alternate frequencies associated with a main frequency for at least first and second regions;

a tuner configured to receive at least first and second radio data system signals;

a processor configured to:

extract a first region table from the first radio data system signal and a second region table from the second radio data system signal, the first and second region tables each including a quantity of alternate frequencies and a list of alternate frequencies, compare the quantity of alternate frequencies for the second region stored in the master table with the quantity of alternate frequencies included in the second region table, compare the list of alternate frequencies included in the second region table with the list of alternate frequencies included in the first region table if the quantity of alternate frequencies included in the second region table is equal to or greater than the quantity of alternate frequencies for the second region stored in the master table, identify one of the alternate frequencies included in the second region table if each of the alternate frequencies in the list of alternate frequencies included in the first region table exists in the second region table, output the identified alternate frequency if each of the alternate frequencies in the list of alternate frequencies included in the first region table exists in the second region table, perform a seek operation if any of the alternate frequencies in the list of alternate frequencies included in the first region table does not exist in the second region table, extract a regional range code from a radio data system signal, and determine whether to output the identified alternate frequency or perform the seek operation based upon the regional range code, wherein determining whether to output the identified alternate frequency or perform the seek operation is based upon the regional range code being indicative of an international code.

10. A device comprising:

a tuner configured to receive at least first and second radio data system signals; and a processor configured to:

extract a first region table from the first radio data system signal and a second region table from the second radio data system signal, the first and second region tables each including a quantity of alternate frequencies and a list of alternate frequencies, compare the quantity of alternate frequencies included in the second region table with the quantity of alternate frequencies included in the first region table, compare the list of alternate frequencies included in the second region table with the list of alternate frequencies included in the first region table if the quantity of alternate frequencies included in the second region table is equal to or greater than the quantity of frequencies included in the first region table, identify one of the alternate frequencies included in the second region table if each of the alternate frequencies in the list of alternate frequencies included in the first region table exists in the second region table, output the identified alternate frequency if each of the alternate frequencies in the list of alternate frequencies included in the first region table exists in the second region table, perform a seek operation if any of the alternate frequencies in the list of alternate frequencies included in the first region table does not exist in the second region table, and store an alternate frequency completion flag, wherein the alternate frequency completion flag is set if each of the alternate frequencies in the list of alternate frequencies included in the first region table exists in the second region table.

11. The device of claim 10, wherein the set alternate frequency completion flag is used for determining whether to perform the seek operation in case the alternate frequency completion flag is not stored, or the alternate frequency completion flag is stored and the regional range code is indicative of an international code or a national code.

* * * * *